US005543580A

United States Patent [19]

Masuda

[11] Patent Number: 5,543,580

[45] Date of Patent: Aug. 6, 1996

[54] TONE SYNTHESIZER

[75] Inventor: Hideyuki Masuda, Hamamatsu, Japan

[73] Assignee: Yamaha Corporation, Japan

[21] Appl. No.: 166,592

[22] Filed: Dec. 10, 1993

Related U.S. Application Data

[63] Continuation of Ser. No. 785,421, Oct. 30, 1991, abandoned.

[30] Foreign Application Priority Data

Oct. 30, 1990 [JP] Japan ..... 2-293396
Oct. 30, 1990 [JP] Japan ..... 2-293397

[51] Int. Cl.[6] ..... G10H 3/12

[52] U.S. Cl. ..... 84/723; 84/724; 84/734

[58] Field of Search ..... 84/626–633, 662–665, 84/658, 687–690, 701–711, 723–725, 729, 730, 732–742, DIG. 10

[56] References Cited

U.S. PATENT DOCUMENTS

| | | | |
|---|---|---|---|
| 3,767,833 | 10/1973 | Noble et al. | 84/687 X |
| 4,085,646 | 4/1978 | Naumann | 84/633 X |
| 4,151,368 | 4/1979 | Fricke et al. | 84/DIG. 10 |
| 4,993,308 | 2/1991 | Villeneuve | 84/724 |
| 5,010,801 | 4/1991 | Sakashita | 84/735 |
| 5,024,133 | 6/1991 | Nakanishi et al. | 84/615 |
| 5,069,106 | 12/1991 | Sakashita | 84/626 |
| 5,117,729 | 6/1992 | Kunimoto | 84/DIG. 10 |
| 5,189,240 | 2/1993 | Kawashima | 84/724 |

FOREIGN PATENT DOCUMENTS

| | | |
|---|---|---|
| 0248527 | 4/1987 | European Pat. Off. . |
| 63-40199 | 8/1988 | Japan . |
| 63-285594 | 11/1988 | Japan . |
| 2-7677 | 6/1990 | Japan . |
| 3-33490 | 4/1991 | Japan . |

OTHER PUBLICATIONS

"On The Oscillations Of Muscial Instruments", M. E. McIntyre, R. T. Schumacher, J. Woodhouse, Acoustical Society of America, Nov. 1983, pp. 1325–1345.

"Air Flow And Sound Generation In Musical Wind Instruments", N. H. Fletcher, Ann. Rev. Fluid Mech. 1979, pp. 123–146.

*Primary Examiner*—Stanley J. Witkowski
*Attorney, Agent, or Firm*—Graham & James LLP

[57] ABSTRACT

A tone synthesizer, for brass instruments, is equipped with a performance information input device such as a mouthpiece having a contact area sensor for detecting the contact area of the lips, a pressure sensor for detecting the push pressure of the lips, and an aperture sensor for detecting the opening surface of the lips. The tone synthesizer is also equipped with an apparatus indicating the strain of the lips, a tone generator, a blow pressure sensor, and a signal transmission apparatus.

19 Claims, 14 Drawing Sheets

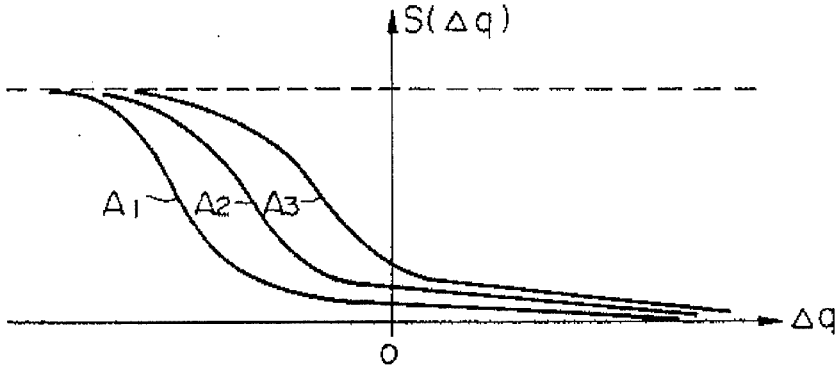
FIG.3(A)
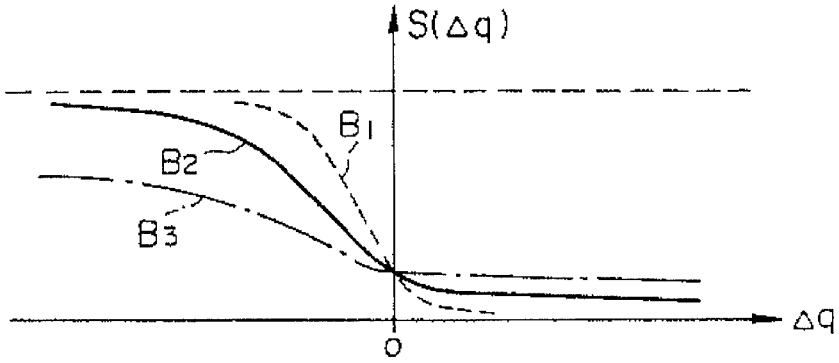
FIG.3(B)
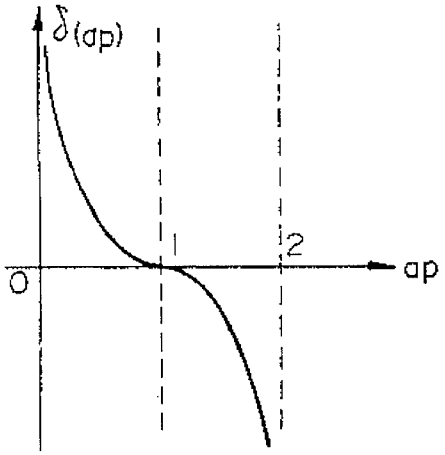
FIG.4(A) FUNCTION δ(ap)
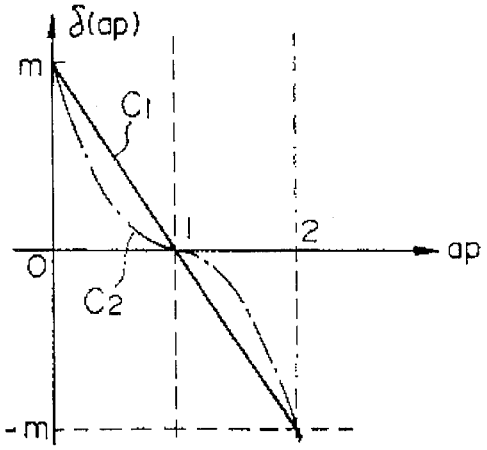
FIG.4(B) FUNCTION δ(ap)

TONE SYNTHESIZER

This is a continuation of application Ser. No. 07/785,421 filed on Oct. 30, 1991 and now abandoned.

BACKGROUND OF THE INVENTION

1. Field of Industrial Application

The present invention relates to a tone synthesizer suitable for simulating acoustic musical instruments whose pitch changes according to the position of the lips of the player.

2. Prior Art

There are methods for synthesizing tones of a natural musical instrument by applying a model obtained by simulating the sound mechanism of natural musical instruments. Especially for the most basic model of a musical wind instrument, like a clarinet, a closed loop structure model is known for connecting non-linear amplification elements simulating elastic characteristics of the reed with bidirectional communication circuits simulating a resonance pipe. In this model, the signal coming from the non-linear amplification element is output, and after being added to the retreat wave signal, this signal is input into the bidirectional communication circuit as a progressing wave signal. Next, this progressive wave signal is reflected at the terminal part of the bidirectional communication circuit and transmitted in the opposite direction of the bidirectional communication circuit. After that, the reflected wave signal is added to the progressive wave signal and fed back to the non-linear amplification element (driving circuit).

Thus, the propagation of the air pressure wave in the wind instrument can be truly simulated by the closed loop circuit consisting of the non-linear amplification element and the bidirectional communication circuit.

Furthermore, in real wind instruments, holes for pitch operation, in other words "tone-holes", are provided; models simulating wind instruments including such tone holes are also known. In this model a signal progressing circuit which is called a signal scattering junction (hereafter referred to as "junction") is inserted between all bidirectional communication circuits, each corresponding to a tone hole. For each input signal from the adjacent bidirectional communication circuit, calculation processing, such as coefficient multiplication, is done by each junction, and the calculation result is supplied to the adjacent bidirectional communication circuit. The multiplication coefficients and the like in this calculation processing are changed according to the opening and closing condition of the tone hole.

In this case, the signal fed back to the non-linear amplification element becomes the sum total of the components returned in each junction. Furthermore, as described above, because the multiplication coefficients used for calculating in the junctions are changed according to the opening and closing condition of the tone hole, finally, the transmission frequency characteristic of the bidirectional circuit side, when seen from the non-linear amplification element, is changed according to the opening and closing condition of the tone hole.

This transmission frequency characteristic becomes a characteristic of a plurality of peaks having resonance frequencies at a frequency (fundamental tone) corresponding to the time delay of the output signal of the non-linear amplification element returned in the junction corresponding to the tone hole of the opening condition until fed back to the non-linear amplification element and all the frequencies (harmonic tones) of approximately multiple integers thereof.

This type of technique was officially disclosed in, for example, Japanese patent application laid open number Sho 63-40199.

Since in the above mentioned art, the main objects for simulation were woodwind instruments, no functions were provided which made it possible to produce a tone based on parameters such as the positioning of the player's lips, force conditions, and stress conditions (conditions of the muscles around the mouth), neither did they provide a construction for detecting the stress condition of the lips. Therefore, in the above-described art, it was extremely difficult to simulate brass instruments where tones are in part decided by the degree of strain of the lips.

SUMMARY OF THE INVENTION

As a result of reflecting on the above-described circumstances, it is an object of the present invention to provide a musical tone synthesizer which can truly simulate the tone of a brass instrument resulting from the tonus of the lips.

(Means for Solving the Problem)

The present invention providing a solution for the above problem comprises a contact area sensor for detecting the contact area of a player's lips so that the area can be contacted by the player's lips, a pressure sensor for detecting a push pressure against the contact area of the lips, a predetermined function in which the detected contact surface and the push pressure are input and which becomes smaller as the contact area increases, and which increases as the push pressure increases, and based on this tonus signal generator which outputs a tonus signal describing the tonus of the lips, and tone signal generator generating a high pitch tone signal as the tonus signal increases.

(Operation)

When the player presses the lips against the contact area sensor, the contact area of the lips is detected in the contact area sensor, and the push pressure of the lips is detected in the pressure sensor.

Furthermore, the tonus signal generator generates a tonus signal which is based on a predetermined function. The tonus signal generator generates a tone signal, the pitch of which becomes higher as said tonus signal increases.

Because of this, the greater the pressure the player puts on the lips, the higher the pitch of the generated tone signal.

BRIEF DESCRIPTION OF THE FIGURES

FIGS. 3(A) and 3(B) show the characteristics of the slit function of lips 3.

FIGS. 4(A) and 4(B) show the characteristics of function δ and an approximation formula.

(Preferred embodiment)

The electrical brass instrument of the first preferred embodiment of the present invention refers to the figures and is explained as follows.

A. Theoretical premises of the preferred embodiment

1. Physical model of brass instruments

The electric brass instrument of the embodiment of the present invention is a simulation of the sound system of a brass instrument. Therein, the physical model of a real brass instrument is referred to and explained in FIGS. 2(A) and (B). The physical model shown in FIGS. 2(A) and (B), is the model model for woodwind instruments by Mcintyre, et al., (M. E. Mcintyre, R. T. Schumacher, J. Woodhouse, "On the oscillations of musical instruments", J. Acoust. Soc. Am. 74(5), November 1983 0001-4966/83/111325-21500.88, 21$00.88, ©1983, Acoustic Society of America), applied for the action of the lips on a brass instrument (lip reed instrument).

Figure 2A:
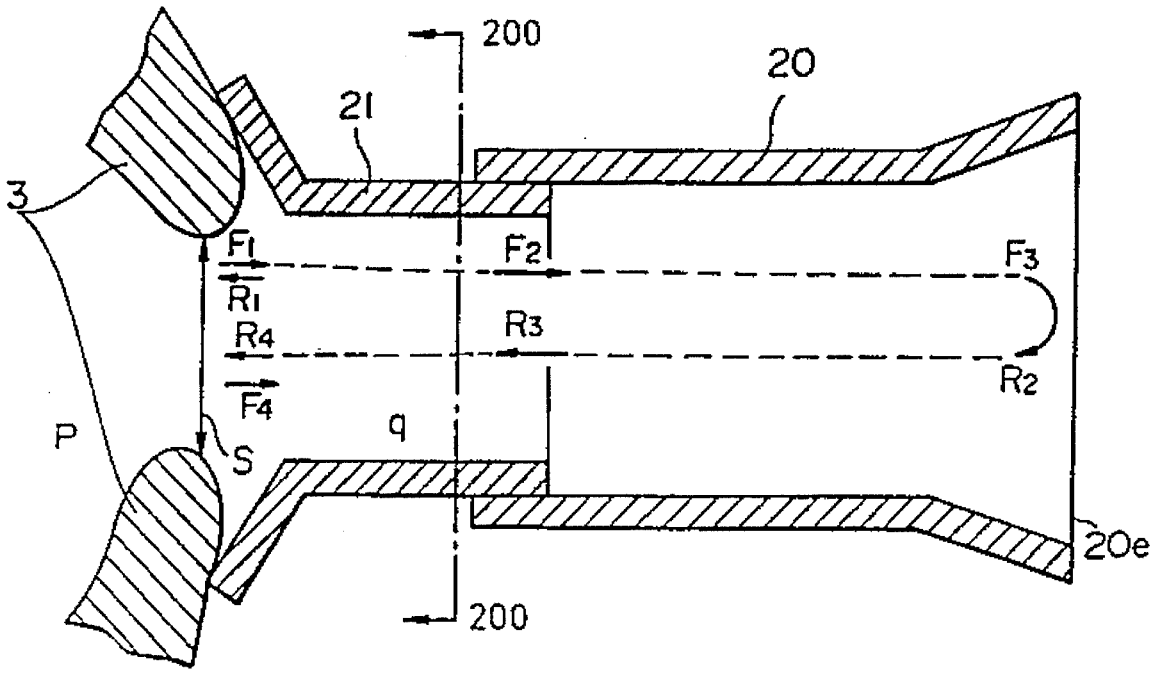
FIGS. 2(A) and 2(B) show a physical model of the sound system of a natural musical instrument.

A mouthpiece 21 is inserted in a resonance tube 20 of a brass instrument, as shown in FIG. 2(A). The player's lips 3 are pressed against mouthpiece 21. When the player blows into mouthpiece 21, the pressure between lips 3 changes and a flux f is generated by the non-linear characteristic of lips 3. At this moment, the pressure change according to this flux f is added to pressure retrieve wave $R_1$, becomes pressure progressive wave $F_1$ and is transmitted towards terminal part 20*e* of resonance tube 20. Pressure progressive wave F1 is reflected at each part of resonance tube 20 while transmitted, and as time passes changes to progressive wave F2 and F3. Then, pressure progressive wave F3 is reflected at terminal part 20*e* and transmitted as reflected wave R2 towards lips 3. This reflected wave R2 is also reflected by each part of resonance tube 20 while transmitted and changes to reflected wave RS and R4 as time proceeds, and is fed back directly between lips 3. The addition result of this reflected wave R4 and the progressive wave F4 at this very moment becomes pressure q right between lips 3. The bigger the difference of the air pressure of the oral part (blow pressure) and the air pressure in the mouthpiece 1 (pressure based on reflected wave R) gets, the bigger the obtained influx speed gets.

Figure 2B:
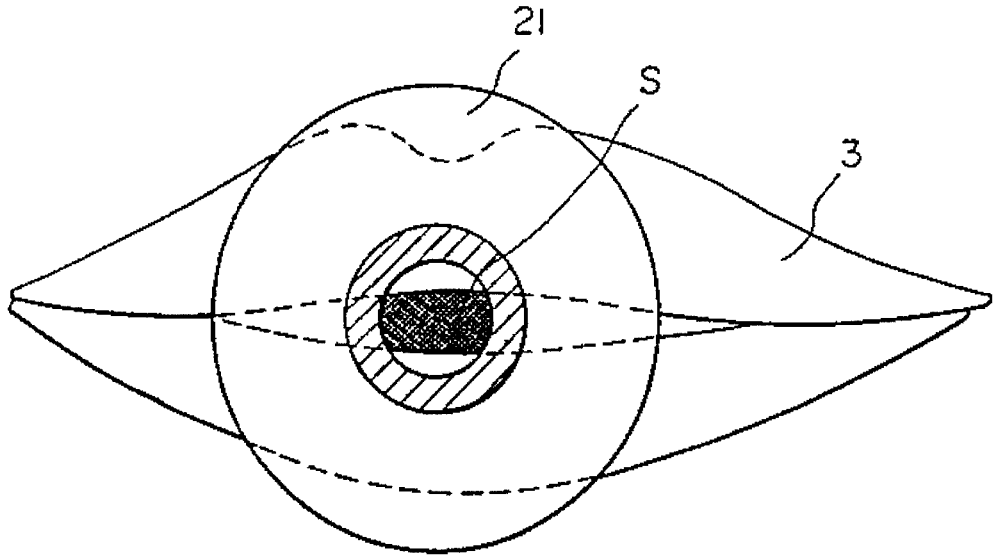

FIG. 2(B) shows a cross section view A-A' as indicated in the same figure (A). The area of the netted part in this figure is the opening area S.

According to Fletcher's thesis (N. H. Fletcher, "Airflow and Sound Generation in Musical Wind Instruments", Ann. Rev. Fluid Mech. 1979. 11: 123-46c 1979 by Annual Reviews Inc. All rights reserved), the biggest difference between the reed of woodwind instruments and the reed of brass instruments (lip reed) lies in the fact, that when the blow pressure is risen, the former reed opens, whereas the latter reed closes. In other words, if the difference of blow pressure p and air pressure of the mouthpiece q is set Δq (Δq=q-p); the opening surface S can be expressed as a function of S(Δq). Hereafter, the function S(Δq) is called slit function. Slit function S(Δq) has characteristics similar to those shown in FIGS. 3(A) and (B). This means, when the player blows into mouthpiece 21, because blow pressure p gets bigger than air pressure q, pressure difference Δq becomes negative. In this case, when lips 3 gradually open wider and therefore pressure difference Δq gets smaller, from a certain point of opening it goes into saturation. On the other hand, when the player blows, pressure difference Δq becomes positive, and while pressure Δq gets bigger, the opening of lips 3 gets smaller and a similar saturation characteristic is reached.

According to Graham's rule, the flux passing a unit area in a unit time (air speed v), when p≧q, can be expressed in equation (A1).

$$\begin{aligned} v &= \{2(p-q)/\rho\}^{1/2} \\ &= L(\Delta q) \end{aligned} \tag{A1}$$

Here ρ is the density. Volume flux f is equal to air speed v times opening area S.

2. Connection between slit function and embouchure

The slit function S(Δq) is not only uniformly determined by pressure difference Δq, but also varies with the structure of lips 3 (embouchure). Embouchure can broadly be classified into aperture (opening conditions of the lips) and strain (tonus of the lips). Hereafter, an explanation on the change of the slit function S(Δq) corresponding to the change of aperture and strain respectively, is given.

(i) The change of the slit function S(Δq) against the aperture is the aperture when there is no blow through the opening area S, and equal to slit function S(Δq) for the case when Δq=0. FIG. 3(A) shows the change in the characteristics of slit function S(Δq) at a fixed strain while the aperture was changed. Lines A1, A2 and A3 in this figure are the characteristics of the function S(Δq) when the aperture was successively enlarged. As it can be clearly seen from the figure, the shape of the lines A1–A3 are similar and can be obtained by shifting the same curve successively to the right.

The curves A1–A3 in FIG. 3(A) can be approximated by using function δ(ap) as shown in FIG. 4. Variable ap is the aperture.

When the relation of FIG. 4 is expressed by a formula, it becomes formula (A2) as stated hereafter.

$$\begin{aligned} ap &= S(\Delta q)\,|\Delta q = 0 \\ &= 1 - \frac{\delta}{(\delta^2+1)^{1/2}} \end{aligned} \tag{A2}$$

And x=Δq/st+δ(ap). If equation (A2) is solved with respect to δ, it becomes $$\delta(ap) = \pm \frac{1}{\left\{ \frac{1}{(1-ap)^2} - 1 \right\}^{1/2}} \tag{A3}$$

The ± sign on the right-hand side of equation (A3) becomes "+" when 0<ap<1 and becomes "–" when 1<ap<2. δ(ap), as shown in equation (A3) and as can be seen from FIG. 4, becomes $$\begin{array}{ll} \delta \rightarrow +\text{infinity} & \text{for } ap \rightarrow 0 \\ 0 & \text{for } ap = 1 \\ \delta \rightarrow -\text{infinity} & \text{for } ap \rightarrow 2 \end{array} \quad \text{(A4)}$$

and is a monotonic decreasing function. That is, the bigger aperture ap gets, the smaller δ gets. Though function δ(ap) can be obtained by formula (A3), it also can be approximated by, for example, linear equation (A5) or cubic equation (A6).

$$\Delta(ap) = -m(ap-1) \quad \text{(A5)}$$

$$\Delta(ap) = -m(ap-1)^3 \quad \text{(A6)}$$

In this case, m is the constant of proportionality. The approximation values of function δ(ap) which can be obtained from approximation equations (A5) and (A6), have the characteristics C1 and C2, as indicated in FIG. 4(B).

(ii) In FIG. 3(B), the change of slit function S(Δq) verses strain and indicates the change of the characteristic of slit function S(Δq) at constant aperture and changing strain. Curves B1, B2 and B3, as indicated in this figure, show the characteristic of slit function S(Δq) for successively enlarged strain. While lips blowing at a high strain (high tonus) don't substantially change opening surface S, lips of low strain (loose) considerably increase area S.

When the curve shown in FIG. 3(B) is to be approximated, slit function S(Δq) can be expressed by equation (A7).

$$S(\Delta q) = \frac{-\gamma}{(\gamma^2+1)^{1/2}} + 1 \quad \text{(A7)}$$

Figure 5:
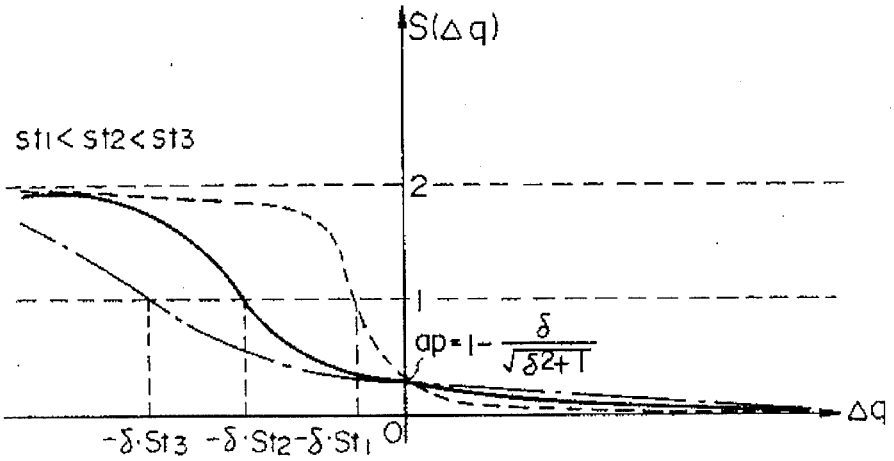
FIG. 5 shows the characteristics of a strain function versus strain.

Wherein, $$\gamma = \Delta q/st + \delta(ap) \quad \text{(A8)}$$

and variable st shows the strain. The graph of slit function S(Δq) for various strains st1, st2 and st3 (wherein st1<st2<st3) is shown in FIG. 5.

3. Frequency selection of slit function

The player of a brass instrument selects and plays by his lips various harmonic tones of the fundamental tone which is decided by the length of the tube. This is the action of a kind of lip filter, wherein the filter characteristic is changed by the closing and spreading condition of the lips. According to the analysis of the inventor of the present invention, it became clear how the amplitude gain ratio Q of the filter formed by the lips, the cut off frequency $f_c$ and compliance C (gain) can be determined by effective oscillation mass m of the lips, attenuation constant μ, elasticity constant k and effective oscillating area $S_B$. Details about this are explained hereafter. Effective oscillating mass m and effective oscillating area $S_B$, are respectively the mass and area of the parts contributing to the vibration of lips 3 (referring to FIGS. 2(A), (B)).

When the displacement of lips 3 is set to be x, motion equation (A9) of lips 3, stated hereafter, is obtained. The time derivation of displacement x is called x' and the second time derivation called x".

$$mx'' + \mu x' + kx = \Delta q \cdot S_B \quad \text{(A9)}$$

Laplace transformation of equation (A9) yields transfer function H(s)

$$H(s) = \frac{X(s)}{\Delta Q(s)} = \frac{S_B}{m} \cdot \frac{1}{s^2 + \frac{\mu}{m}s + \frac{k}{m}} \quad \text{(A10)}$$

When equation (A10) is changed round, equation (A11) is obtained.

$$H(s) = \frac{\frac{S_R}{m} \cdot \frac{1}{s^2}}{1 + \frac{\mu}{m} \cdot \frac{1}{s} + \frac{k}{m} \cdot \frac{1}{s^2}} \quad \text{(A11)}$$

The transfer function of an analog filter in general having a normalized peak gain (DC gain is q), a cut off frequency $f_c$ and an amplitude gain ratio Q becomes $$H(s) = \frac{a^2 b}{s^2 + abs + a^2} \quad \text{(A12)}$$

when $a = 2\pi f_c$ and $b = 1/Q$.

When this is compared with transfer function H(s) of equation (A10), equations $$a = \sqrt{k/m} \quad \text{(A14)}$$

$$b = \frac{\mu/m}{\sqrt{k/m}} = \frac{\mu}{\sqrt{k/m}} \quad \text{(A15)}$$

hold, and amplitude gain ratio Q and cut off frequency $f_c$ become $$Q = \frac{\sqrt{k/m}}{\mu} \quad \text{(A16)}$$

$$f_c = \frac{\sqrt{k/m}}{2\pi} \quad \text{(A17)}$$

When the numerator of transfer function H(s) is set to be $S_R/m = a^2 b \cdot C$, peak gain of transfer function H(s) obviously becomes equal to compliance C. DC gain is $C \cdot b = S_R/k$).

So this yields for compliance C $$C = \frac{S_R/m}{a^2 b} = \frac{S_R/m}{\frac{k}{m} \cdot \frac{\mu}{\sqrt{m \cdot k}}} = \frac{S_R \cdot \sqrt{m/k}}{\mu} \quad \text{(A18)}$$

When the tonus of lips 3 in FIG. 2(A) rises, the muscles of lips 3 touching the mouthpiece become thin; the attenuation coefficient B, the effective oscillating mass m and the effective oscillating area $S_B$ become small. Consequently, according to equation (A16) and (A17), it seems that amplitude gain ratio Q becomes small and cut off frequency $f_c$ becomes big. But, by putting strain on the lips, at the same time the elasticity constant k becomes big and in the end the amplitude ratio Q and cut off frequency $f_c$ both get bigger. Since the elasticity constant k becomes extremely big when compared to single reeds of woodwind instruments, in this case, amplitude ratio Q also becomes extremely big in comparison with woodwind instruments. Therefore, in brass instruments, a specific sound mode can be created by a mere tonus of the lips. When lips 3 are strained, according to equation (A18), the aperture is made small in such a way that the effective oscillating area $S_B$ and the effective oscillating mass m don't become too small; when elasticity constant k only is set to be big, the peak gain becomes big and it is obvious that the desired tone can easily be formed.

Since it is always equivalent when lips 3 are pressed against mouthpiece 21 or lips 3 are strained by an outer force, a similar phenomenon is offered when lips 3 are made to strain.

On the other hand, when lips 3 are relaxed or push pressure against mouthpiece 21 loosens, above mentioned phenomenon appears the other way round.

4. Calculation method of strain st

Though strain st, as explained above, is an important parameter for determining the characteristic of the tone, and since this is the degree of strain coming from the muscle around the mouth (ring muscle of the mouth), a direct detection becomes very difficult.

But when you think of a status where the lips are relaxed and push easily against a flat board, even when this push pressure is comparatively small, the contact area of the lips against the flat board is big, whereas, when the lips are strained, the contact area becomes small, an experience which was verified above. But when the push pressure of the lips is increased while the tonus of the lips is kept constant, the contact surface of the lips against the flat board gets bigger, a fact which was clarified above.

The preferred embodiment of the present invention provides a contact area sensor in the mouthpiece and a pressure sensor based on the principle stated above, and further provides means for calculating strain st on the basis of the detected values thereof. The contact area sensor is formed as a flat board, which when touched on one side by lips 3, detects the contact area $S_L$ and makes an output of it. More details concerning the sensors are stated hereafter. The pressure sensor is provided on the other side of said contact area sensor, and when lips 3 press against the contact area sensor, this push pressure $P_L$ is detected and put out.

Figure 6A:
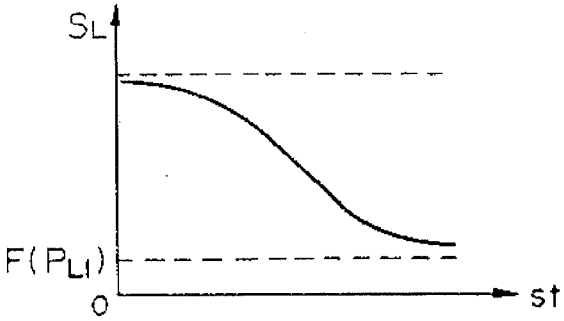
FIGS. 6(A) and 6(B) show the characteristics of contact area $S_L$ versus strain st of lips 3. The same

For the case that push pressure $P_L$ is fixed at a value ($P_{L1}$) and strain st is changed, as shown in FIG. 6(A), the contact area $S_L$ has a saturation characteristic in form of a monotonic decreasing function. Furthermore, when push pressure $P_L$ is increased and set on a fixed value ($P_{L2}$), contact area $S_L$ is obtained similarly and the characteristics as shown in the same FIG. 6(B) can be obtained. The characteristic of the same FIG. 6(B) can be equally obtained by just shifting the characteristic of same FIG. 6(A) vertically up, according to the shift distance.

When $P_L$ is increased, the value of this shift distance goes into saturation. Consequently, when this shift distance is described as a function $F(P_L)$, function $F(P_L)$ becomes a function having the saturation characteristic as shown in the same FIG. 6(C).

Figure 6B:
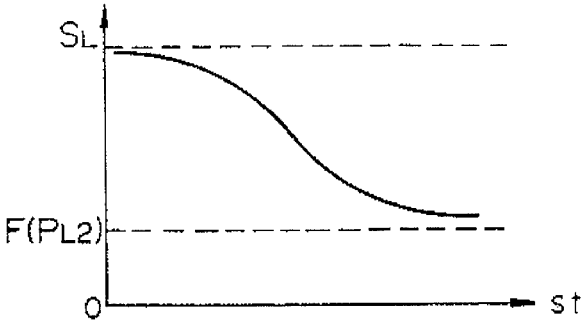

The characteristic of contact area $S_L$ shown in the same FIGS. 6(A) and 6(B), is approximated in equation (A19), as stated hereafter.

$$S_L = \frac{K_1}{1 + e^{(st-\Theta_1)}} + F(P_L) \tag{A19}$$

Figure 6C:
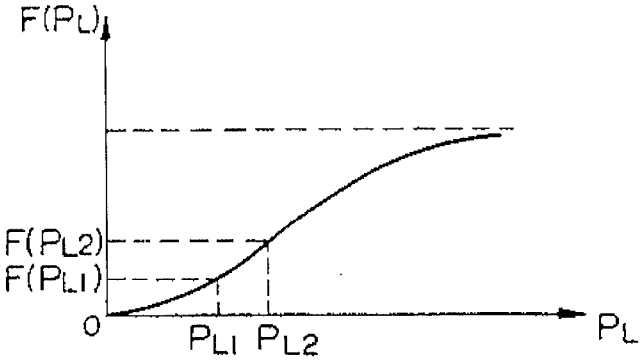
FIG. 6(C) shows the characteristics of function $F(P_L)$.

Function $F(P_L)$, shown in the same FIG. 6(C), can be approximated by equation (A20) stated hereafter.

$$F(P_L) = \frac{K_2}{1 + e^{(\Theta_2 - P_L)}} \tag{A20}$$

In equations (A19) and (A20) $\Theta_1$, $\Theta_2$, $K_1$ and $K_2$ are all positive constants.

When equations (A19) and (A20) are solved with respect to strain st, equation (A21) is obtained as stated hereafter. $st=G(P_L, S_L)$ $$\begin{aligned} st &= G(P_L, S_L) \\ &= \log_e\left(\frac{K_1}{S_L - \frac{K_2}{1 - e^{(\Theta_2 - P_L)}}} - 1\right) + \Theta_1 \end{aligned} \tag{A21}$$

Consequently, strain st can be obtained from equation (A21) when contact area $S_L$ and push pressure $P_L$ are known.

B. Complete device of the preferred embodiment

Figure 1:
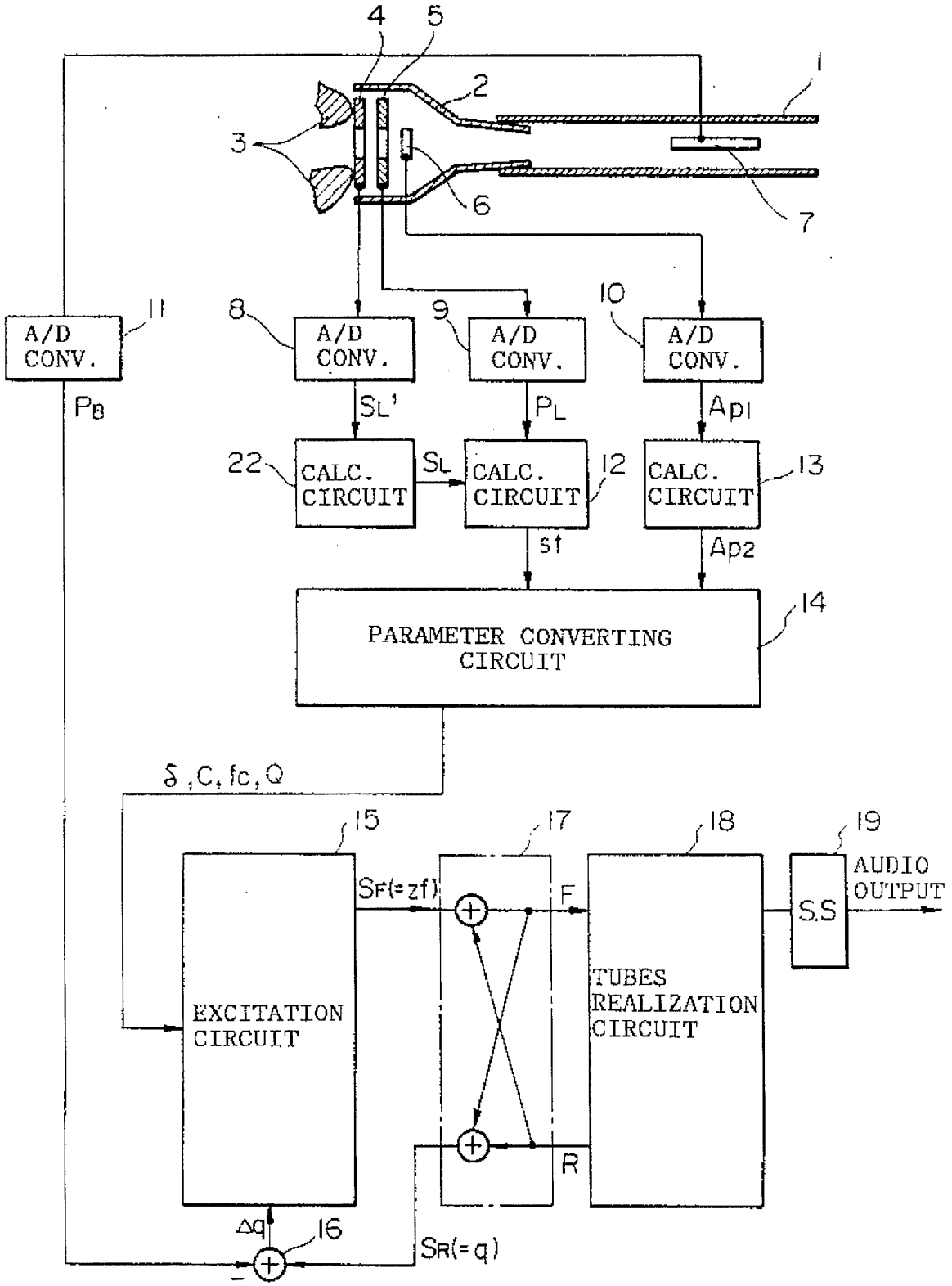
FIG. 1 shows a block diagram of the whole device representing an electronic brass instrument which is the preferred embodiment of the present invention.

Based on the previously presented theory, a complete device of the embodiment of the present invention is explained by referring to FIG. 1.

In this figure, there is a main part 1 of an electronic brass instrument and an inserted mouthpiece 2. In the inner part of mouthpiece 2 there is a contact area sensor 4 which outputs the detected contact surface of lips 3 when being pressed by lips 3 of the player. Furthermore, there is a pressure sensor 5 which detects the push pressure when lips 3 press against contact area sensor 4. Moreover, there is an aperture sensor 6 which detects the opening area of lips 3. Furthermore, an air pressure sensor 7 provided in the inner part of main body part 1 measures the blow pressure generated by the player. The output signal of sensors 4–7 are transformed into digital signals via corresponding A/D converters 8–11. In other words, the signal $S_L$ coming from A/D converter 8 describing the contact area of lips 3, signal $P_L$ from A/D converter 9 describing the push pressure of the lips, signal $A_{P1}$ from A/D converter 10 describing the opening area of the lips and blow pressure signal $P_B$ from A/D converter 11 describing the blow pressure are all output.

A calculation circuit 12 which outputs signal st describing the tonus of the lips, is based on said signal $S_L$ and $P_L$, and equation (A21).

Figure 17:
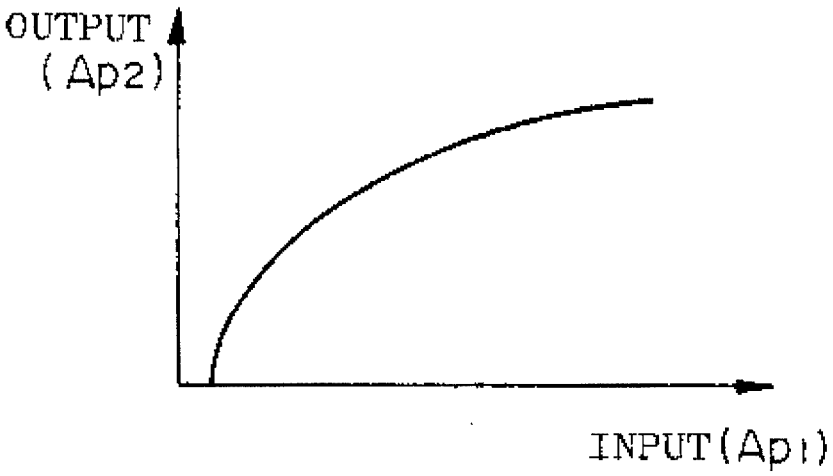
FIG. 17 shows the characteristic of operation circuit 13.

Furthermore there is a calculation circuit 13 carrying out a predetermined correction on said signal $A_{P1}$ and outputs it as signal $A_{P2}$. This is done, because signal $A_{P1}$ depending on the characteristic of aperture sensor 6 stated hereinafter and opening area of lips 3 are not exactly proportional; so it is corrected to signal $A_{P2}$ in such a way that it becomes exactly proportional to the opening area. The correction is carried out on the basis of a monotonic increasing function, as shown in FIG. 17. Calculation circuit 13 may also be a table having the input-output characteristic as shown in FIG. 17.

Furthermore, there is a parameter converting circuit 14 which converts above said signals st and $A_{P2}$ corresponding to the condition of lips 3, into the parameters δ, C, $f_c$ and Q corresponding to the characteristics of the sound, and outputs them. As explained in equation (A3) parameter δ can immediately be decided in connection with aperture ap. As explained in equations (A16)–(A18), the parameters C, $f_c$ and Q are respectively the parameters describing the peak gain of the tone, the cut off frequency and the amplitude gain ratio.

A flux calculation part 15 outputs an excitation signal $S_F$ which is based on said parameters δ, C, $f_c$, Q and pressure difference signal Δq (details hereinafter) output from a subtracter 16. Excitation signal $S_F$ is the adequate signal for the pressure change of the air (compression wave) which is generated at the entrance of mouthpiece 21 in the model shown in FIG. 2(A).

Excitation signal $S_F$ is added by junction 17 to the reverse wave pressure R and is output as progressive wave F to the tubes realization circuit 18. The tubus realization circuit 18 connects the delay circuit simulating the propagation delay of the oscillation in the tubus, a low-pass filter simulating the loss at the tubus, and a reflection circuit simulating the reflection of the oscillation in the terminal part 20*e*, to become a closed loop, and simulating the whole part 20 in the model of FIG. 2(A) as the whole body. In other words, in the closed loop of tubus realization circuit 18, progressive wave signal $S_F$ corresponding to progressive wave F in FIG. 2(A), is propagated. This progressive wave signal F is extracted via a sound system 19 and output as a sound signal. In the reflection circuit simulating the terminal part, reflected wave signal R is generated by reflecting the progressive wave signal F. This reflected wave signal R is propagated in the opposite direction of the propagation direction of progressive wave signal F, added to progressive wave signal F at junction 17 and passed on to subtracter 16 as pressure SR. For such a junction 17 and such a tubus realization circuit 18, a generally known junction and tubus realization circuit or similar devices may be used to simulate the woodwind instruments; for example, a variety of circuits disclosed by the applicant in Japanese patent application number 1-1012308, Japanese application number 1-259735, Japanese patent application number 1-258229 and others are suitable for use.

In subtracter 16 the blow pressure signal $P_B$ is subtracted from the reflective wave signal $S_B$ and the subtraction result is passed on to above explained excitation circuit 15 as difference signal Δq.

Hereinafter, a detailed description of all the parts used in the device mentioned above, is given.

C. Construction of the sensor parts

Figure 7:
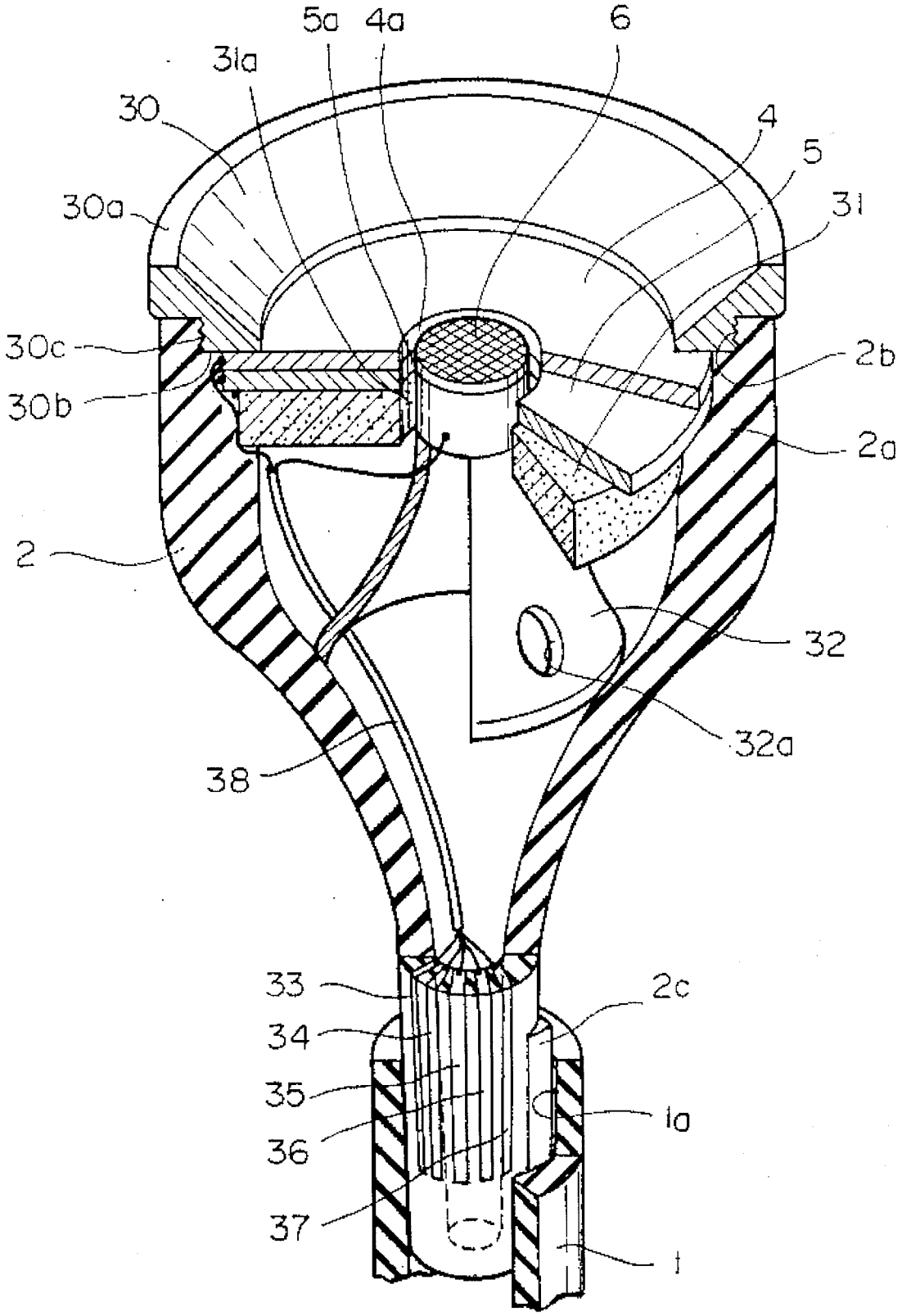
FIG. 7 shows a partial notch projection of mouthpiece 20.

A detailed description of sensors 4, 5 and 6 provided in mouthpiece 2 refers to FIG. 7.

1. Details on all sensors in mouthpiece 2

In this figure, mouthpiece 2 is formed to a funnel shape like device by insulating material; it's mouthpiece part 2*a* has an inside wall which is notched in step form such that the centers of the diameters successively lie on the middle axes, wherein the first step which is the biggest diameter is formed as nut/screw part 2*b*. A rim contour 30 made of metal or resin is formed to approximate the tubus shape, and from it's inner rim 30*a* in direction to the other rim 30*b* the inner radius gets smaller. The neighborhood of the other rim 30*b* is notched in along the axis all around the outer wall, and is formed to bolt/screw part 30*c* screwing into nut screw part 2*b*.

In the second step of the notch formed in a step, contact area sensor 4 and pressure sensor 5 are put in. Contact area sensor 4 is provided with a concentric throughhole 4*a*, and the outside diameter has the form of a disk shape which is equal the second step of the step formed notch part. The outer radius of pressure sensor 5 is equal to the one of contact area sensor 4, and also formed in a disk shape provided with the concentric throughhole 5*a* having the same diameter as throughhole 4*a*.

In the third step of the step notch an elastic body 31 of independent bubble shape is provided. The outer diameter of elastic body 31 is equal to the third step of the notch and is formed in a disk shape which is provided with a concentric throughhole 31*a* having the same diameter as hole 4*a*.

The aperture sensor 6 is formed in a cylindric shape with a radius slightly smaller than the radius of hole 4*a*, inserted into throughholes 4*a*, 5*a*, 31*a*, and fixed by the support part material 32 which has a funnel shape. The wall of support part material 32 is provided with a throughhole 32*a* used as air-passage.

Furthermore, there are electrodes 33–37 which are connected to contact area sensor 4, pressure sensor 5 and aperture sensor 6 via reed cable 38. In main body part 1 electrodes (see figure) are provided which contact each of said electrodes 33–37. In mouthpiece 2 pushlines 2*c* used for guiding in direction parallel to the axis are provided, and go into cavity part 1*a* which is formed in main body part 1.

2. Construction of area sensor 4

Figure 8A:
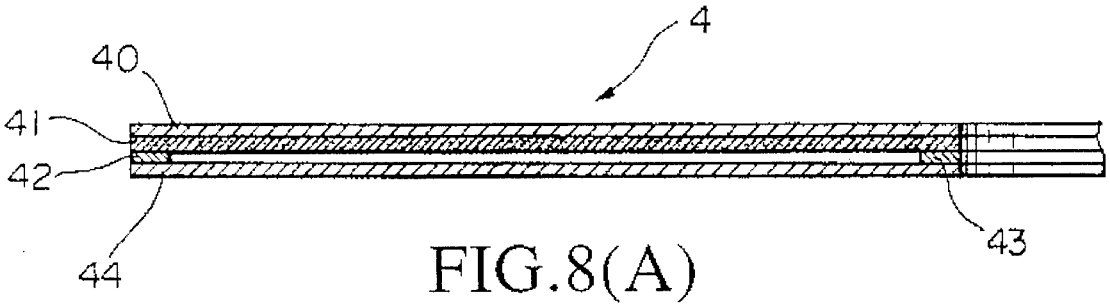
FIGS. 8(A) and 8(B) shows a cross section of contact area sensor 4.
Figure 8B:
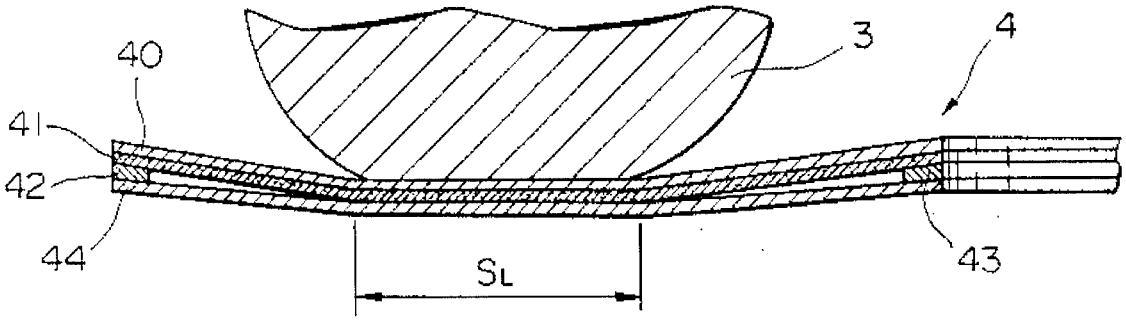

The construction of area sensor 4 is explained by referring to FIGS. 8(A), (B).

In the same figure (A) there is a conductive plate 40 formed in the shape of an annulus ring which covers the surface of the contact area sensor 4. A resistor membrane 41 is attached to the lower surface of the conductive plate 40. Moreover, there is a conductive plate 44 similarly formed as conductive plate 40 and fixed on the opposite side in a small distance of separating resistor membrane 41. Furthermore, there are ring spacers 42 and 43 inserted in the rim part between conductive plate 44 and resistor membrane 41.

In the same figure (B) a cross section is shown for the case that lips 3 are pushed on the upper surface of conductive plate 40. As shown in the figure, when lips 3 press against the conductive plate 40, conductive plate 40 and resistor membrane 41 bend and resistor membrane 41 touches conductive plate 44. This contact area is approximately the same as contact area $S_L$ of lips 3 with conductive plate 40. Accordingly, the reciprocal number of the resistor value between conductive plate 40 and conductive plate plate 44 can be compared with conductive area $S_L$, and by measuring the reciprocal number of this resistor value, a possibility for detecting contact area $S_L$ is given.

3. Structure of pressure sensor 5

Figure 9A:
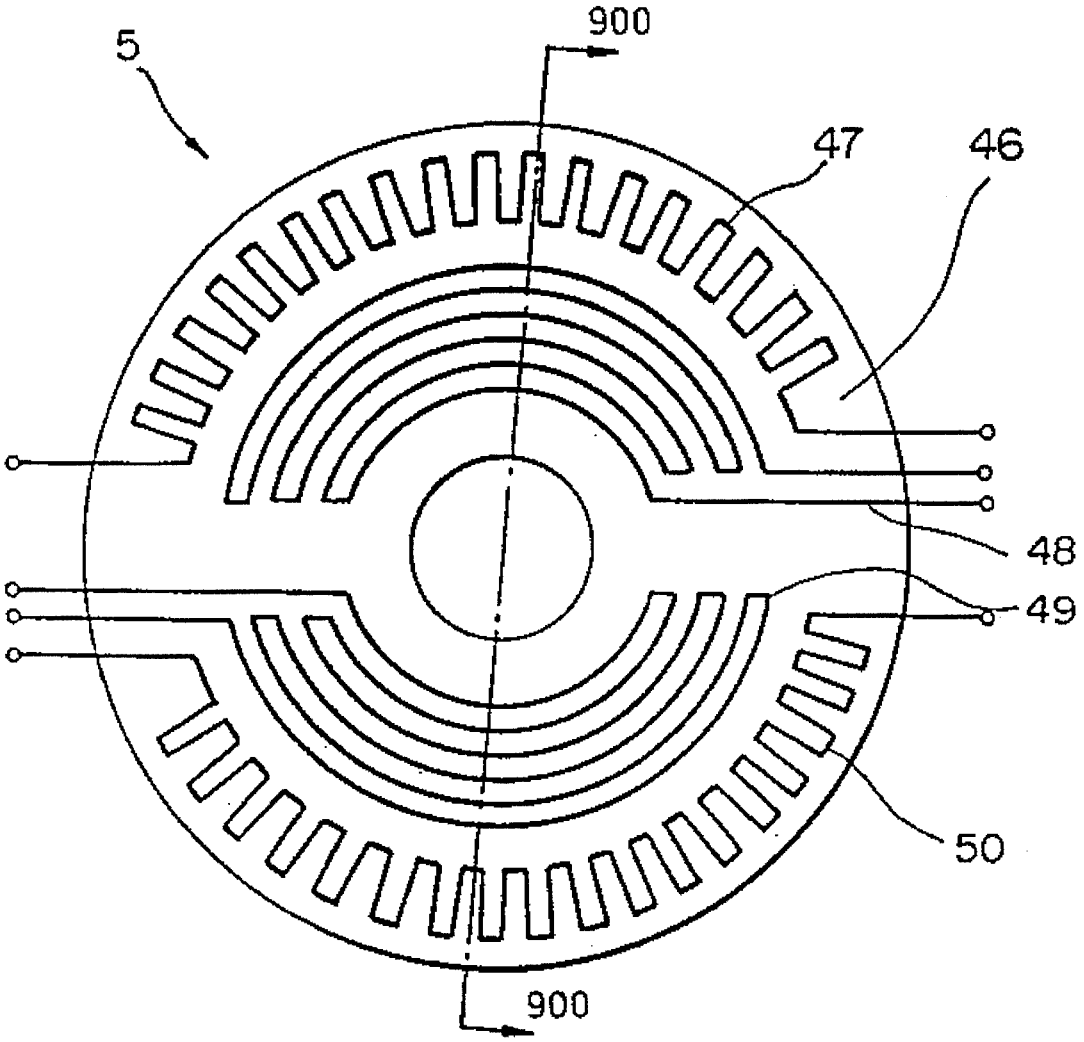
FIG. 9(A) shows the s face of pressure sensor 5; same FIG. 9(B) explains this operation.

The structure of pressure sensor 5 is explained by referring to FIGS. 9(A) and (B).

Figure 10:
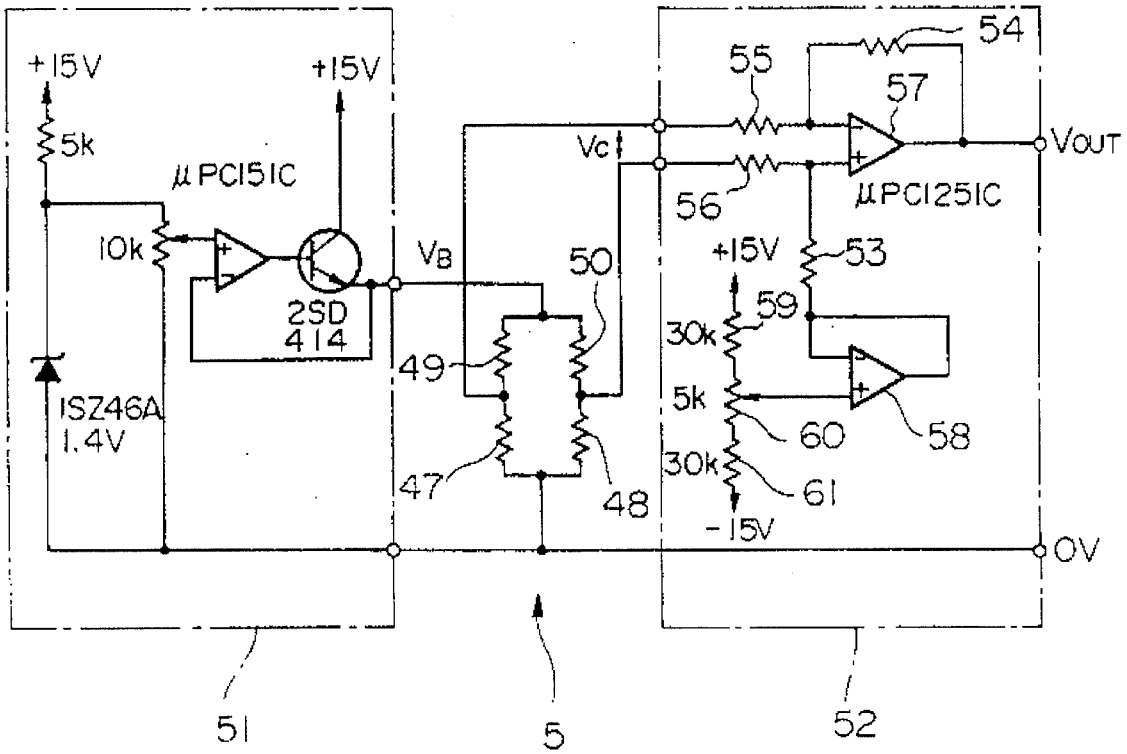
FIG. 10 shows the supplementary circuit of pressure sensor 5.

Pressure sensor 5 in the same figure (A) consists of a cylindrical plate 46, and resistor membranes 47–50 which are attached at the lower surface of resistor plate 46. For resistor plate 46, preferably, for example, polyester film base or polypropylene film base is used. The resistance values of resistor membranes 47–50 are formed in such a way, that when insulating plate 46 is not bent the identical value R is obtained. The same figure (B) shows a cross section of how contact area sensor 4 is placed upon pressure sensor 5, and the condition where lips 3 push against area sensor 4. As shown, by bending insulation board 46 and because resistor membranes 48 and 49 vary and increase in radial direction, the resistance values of these resistor membranes increase. On the other hand, since resistor membranes 47 and 50 shrink in radial direction, the resistance values of these resistor membranes decrease. Since the changing part of the resistance value of resistor membranes 47–50 get bigger as the push pressure of lips 3 get bigger, based on the resistance value of these resistor membranes 47–50, measuring push pressure of lips 3 becomes possible. The concrete construction of the circuit is shown in FIG. 10.

In this figure resistor membranes 49, 47, 48 and 50 are successively connected to a ring and forming a bridge. A constant voltage $V_B$ is impressed via a constant voltage source 51 on the connection points of resistor membranes 49 and 50, and the connection point of resistor membrane 47 and 48. When pressure sensor 5 is in an unbent condition and therefore the resistor values of all resistor membranes 47–50 become a fixed value R, voltage $V_c$ between connection point of resistor membranes 47 and 49, and connection point of resistor membranes 48 and 50 becomes 0 Volt.

Figure 9B:
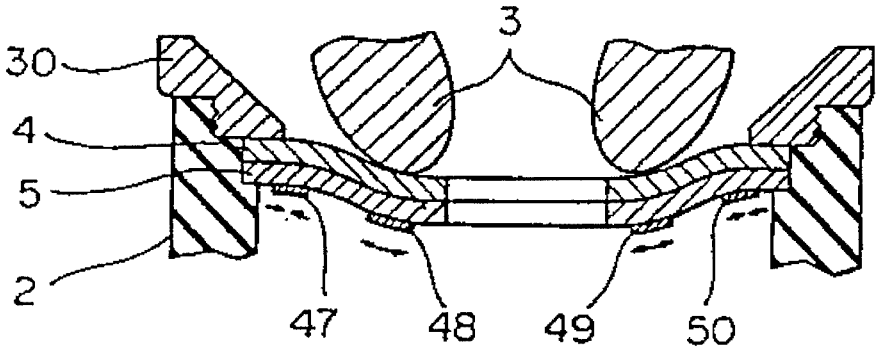

If pressure sensor 5 bends as shown in FIG. 9(B), the resistance value of resistor membranes 47–50 change, and if the resistance values of resistor membranes 47 and 50 are set to R-ΔR and the resistance value of resistor membrane 48 and 49 set equal to R+ΔR, voltage Vc can be expressed by equation (C1)

$$V_c = \frac{\Delta R}{R} \cdot V_B \tag{C1}$$

Said voltage $V_c$ is amplified by differential amplifier 52 and output as voltage $V_{out}$. The amplification rate of amplifier 52 is decided by the resistance value of resistors 53–56 provided in the inner part. In other words, if the resistance values of resistors 55 and 56 are set to $r_1$ and the resistance values of resistors 53 and 54 are set to be $r_2$, the amplification rate of differential amplifier 52 becomes $r_1/r_2$. In differential amplifier 52, a zero potential regulator circuit comprising operation amplifier 58, resistor 59 and 61, and a variable resistor 60, is provided. The output voltage $V_{out}$ of differential amplifier 52 becomes as described in equation (C2). When the extent of variation of the resistor is compared with push pressure of lips 3, the ratio of push pressure of lips 3 and voltage $V_{out}$ can be output.

$$Vout = \frac{\Delta R}{R} \cdot \frac{r_1}{r_2} \cdot V_B \quad \text{(C2)}$$

4. Structure of aperture sensor 6

Figure 11:
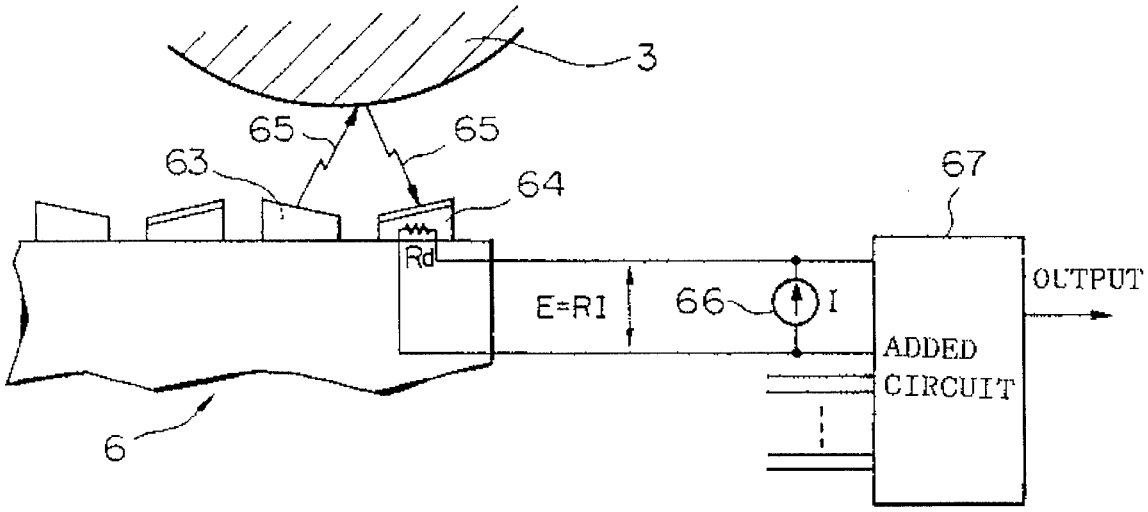
FIG. 11 shows the function of aperture sensor 6.

The structure of aperture sensor 6 is explained by referring to FIG. 11.

As shown in the figure, radiation elements 63 radiating light 65, and photocells 64 of, for example, $C_dS$-type, diminishing the resistance value when light 65 falls in, are provided on the upper side of aperture sensor 6. A constant current source 66 is connected in parallel with photocells 64. When the decided resistance corresponding to the quantity of light on the photocells 64 is set to be resistance R, and if the current output by the constant current source 66 is set equal to I, a voltage E=IR is generated between both ends of photocells 64, and this voltage is impressed to an added circuit 67. When light 65 falls on photocells 64, it is obvious that the voltage impressed on added circuit 67 decreases.

On the upper side of aperture sensor 6, a plurality of radiating elements similarly constructed as radiating element 63, and the same number of photocells, similarly constructed as photocells 64 are provided. All photocells, just like photocells 64, are connected to added circuit 67 via the corresponding constant current source. Added circuit 67 has the voltage coming out on both ends of all photocells and outputs the addition result.

According to the construction explained above, as lips 3 keep approaching the photocells, light emitted by the radiating elements is reflected by lips 3, falls into said photocells and the voltage impressed on added circuit 67 decreases. On the other hand, if lips 3 don't get close to the photocells, the voltage impressed on the added circuit 67 increases. Therefore, it becomes obvious, the bigger opening area S (see FIG. 2(B)) gets, the higher becomes the output level of added circuit 67.

5. Other example of the sensor part

Above explained sensors 4, 5 and 6 may be varied in different ways, as stated by examples given hereafter.

(i) variation example 1

Figure 12A:
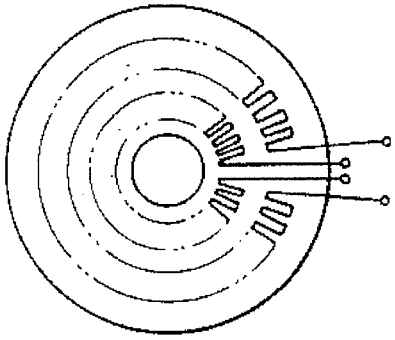
FIGS. 12(A) and 12(B) show the surface of a variation example of pressure sensor 5.
Figure 12B:
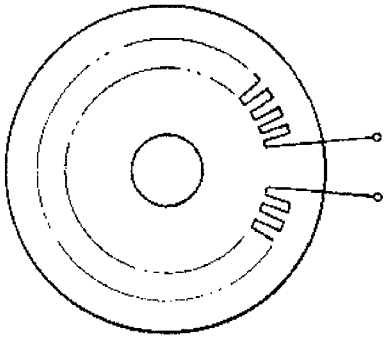

Though pressure sensor 5 in FIG. 9 comprises four resistant membrane elements 47 to 50, the number of resistant membranes may also be 2 or 1, as shown in FIGS. 12(A), (B).

In FIG. 9(B), resistor membranes 47 to 50 are provided on the upper side, but 'these resistor membranes may also be provided at the bottom side (the side of contact area sensor 4).

(ii) variation example 2

Figure 13A:
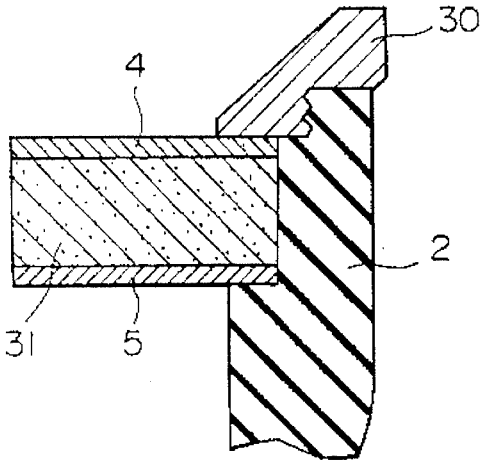
FIGS. 13(A), 13(B), and 13(C) show a cross section of a principal variation example concerning mouthpiece 2.

The positioning of sensors 4 and 5 may also be varied as indicated in FIG. 13(A). In this figure, elastic body 31 is inserted between contact area sensor 4 and pressure sensor 5.

(iii) variation example 3

Figure 13B:
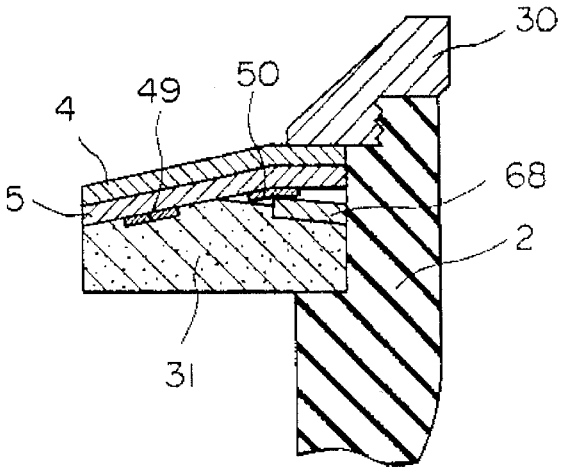
Figure 13C:
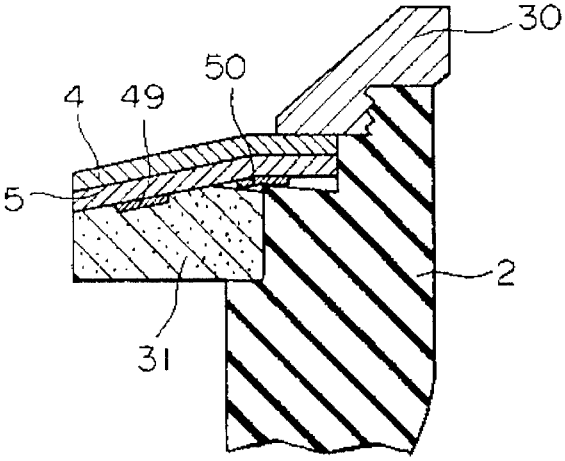

The positioning of sensors 4 and 5 may also be varied as indicated in FIG. 13(B). In this figure, elastic body 31 has an inwardly tapered shape, and contact area sensor 4 and pressure sensor 5 also follow this tempered shape. An elasticity enforcing ring 68, touching resistor membrane 50, is adhered to the inner surface of mouthpiece 2.

When lips 3 (as shown in the figure) are pressed against contact area sensor 4, according to the above said construction, it becomes obvious that the sensitivity increases by increasing the curvature of resistor membrane 50.

Instead of providing an elasticity enforcing ring 68, as shown in the same figure (C), mouthpiece 2 has a thick shape inwardly, and the same result can be obtained by making this inner wall touch resistor membrane 50.

(iv) variation example 4

Figure 14:
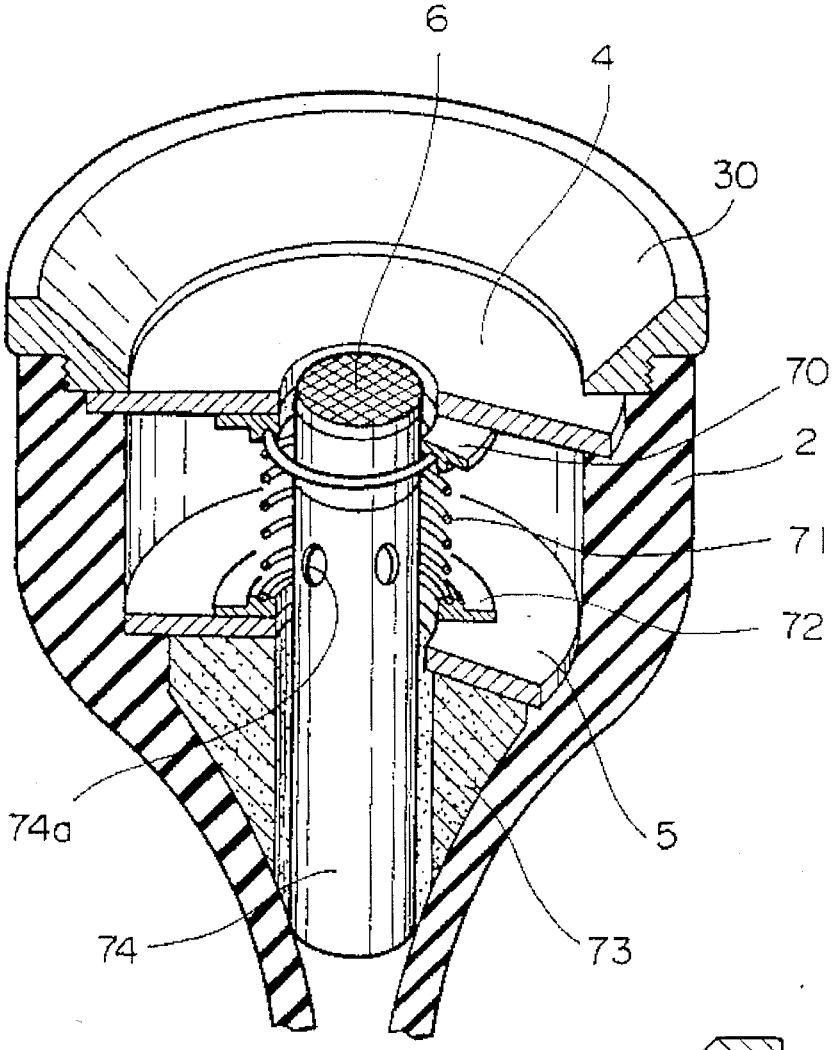
FIG. 14 shows a partial notch projection of a variation example of mouthpiece 2.

The positioning of sensors 4, 5 and 6 may also be varied as indicated in FIG. 14. In this figure, it is arranged that contact area sensor 4 and pressure sensor 5 are set apart at a fixed distance, and for successively separating both parts, a spring holder 70, a coil spring 71 and a spring holder 72 are provided. Contact area sensor 4 is adhered to spring holder 70, which also holds one end of coil spring 71. Similarly, pressure sensor 5 is adhered to spring holder 72, which itself holds the other end of coil spring 71. As indicated in this figure, elastic body 73 is filled in underneath of pressure sensor 5. Next, there is a supporting part 74 having a cylindrical shape and supporting aperture sensor 6, provided with throughholes penetrating from the outer to the inner wall, and being fixed to the inner wall of mouthpiece 2.

According to the above said construction, when lips 3 (as shown in the figure) are pressed against contact area sensor 4, pressure sensor 5 is pressed via coil spring 71, and this push pressure is detected. So when there are small fluctuations in the push pressure of lips 3, these fluctuations are absorbed by coil spring 71 and not transmitted to pressure sensor 5. Accordingly, it becomes obvious that coil spring 71 has the function of a noise absorbing means.

It is obvious that spring holder 70 and 72 respectively together with contact area sensor 4 and pressure sensor 5 may also be formed as one body.

(v) variation example 5

The insulation plate 46 used for pressure sensor 5 does not necessarily have to be a flat board, there also may be channels 46(A) to 46(d) having cylindrical shape and placed on the rear side, where resistance membranes 47 to 50 are fixed. According to the construction mentioned above, if lips 3 (as shown in the figure) are pressed against contact area sensor 4 and therefore the curvature in the place where channels 46(A) to 46(*d*) were formed in insulation plate 46 increases, the sensitivity of pressure detection goes up. As shown in the figure, if the inner wall of mouthpiece 2 is positioned in the direct neighborhood of resistor membrane 50, this result gets even more remarkable.

Figure 15A:
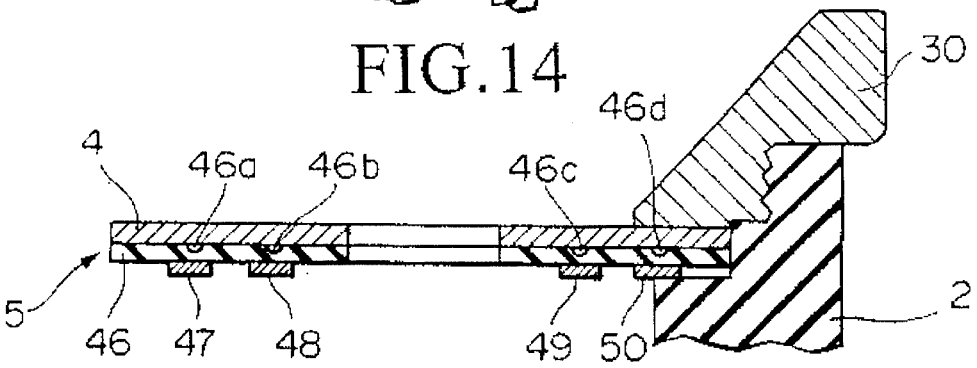
FIGS. 15(A) and 15(B) shows a cross section of a variation example of pressure sensor 5.
Figure 15B:
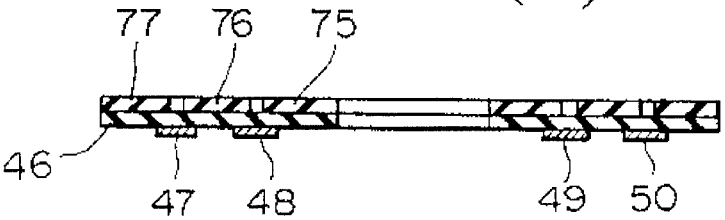

Insulation plate 46 in FIG. 15(A) may also be constructed as shown in the same figure (B). In this figure, the ring-shaped insulation plates 75 to 77 in insulation plate 46 are separated in a predetermined interval and fixed. The disclosed area of insulation plate 46, bordering the space of insulating plates 75 to 77 forms the backside to which resistor membranes 47 to 50 are fixed.

(vi) variation example 6

Figure 16:
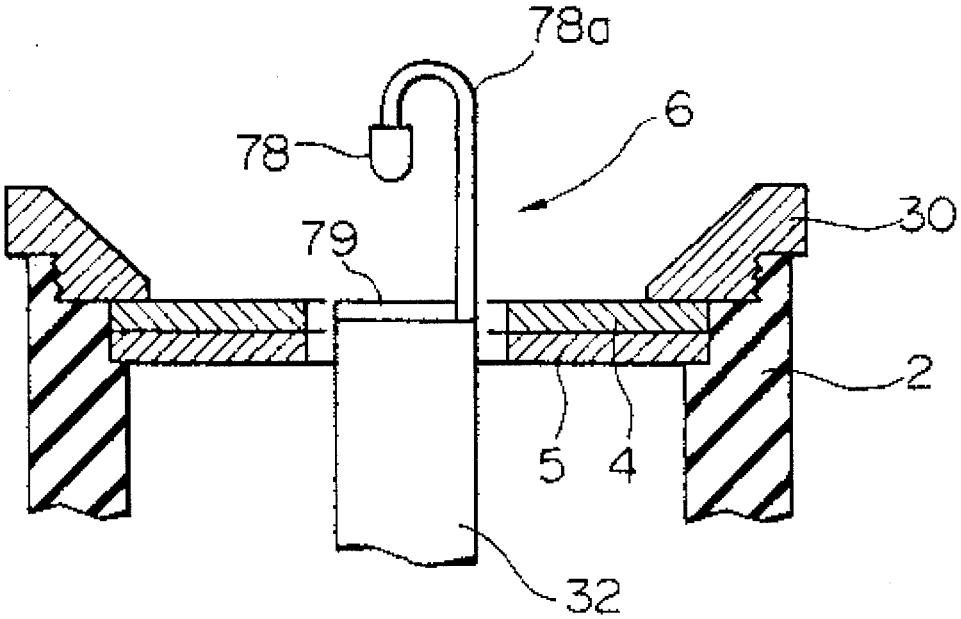
FIG. 16 shows a front view of a variation example of aperture sensor 6.

Aperture sensor 6 can also be constructed as shown in FIG. 16. The aperture sensor 6 in this figure consists of an LED 78 setup by a metallic part 78(A) and a photocell 79 of, for example, CDS type, detecting the light emitted from LED 78. When LED 78 is introduced into the mouth of the player, the amount of light falling on photocells 79 corresponding to the opening area of lips 3 (see figure), can be determined, and therefore, by detecting this amount of light, the aperture can be detected.

(D) Construction of the parameter variation circuit

Figure 18:
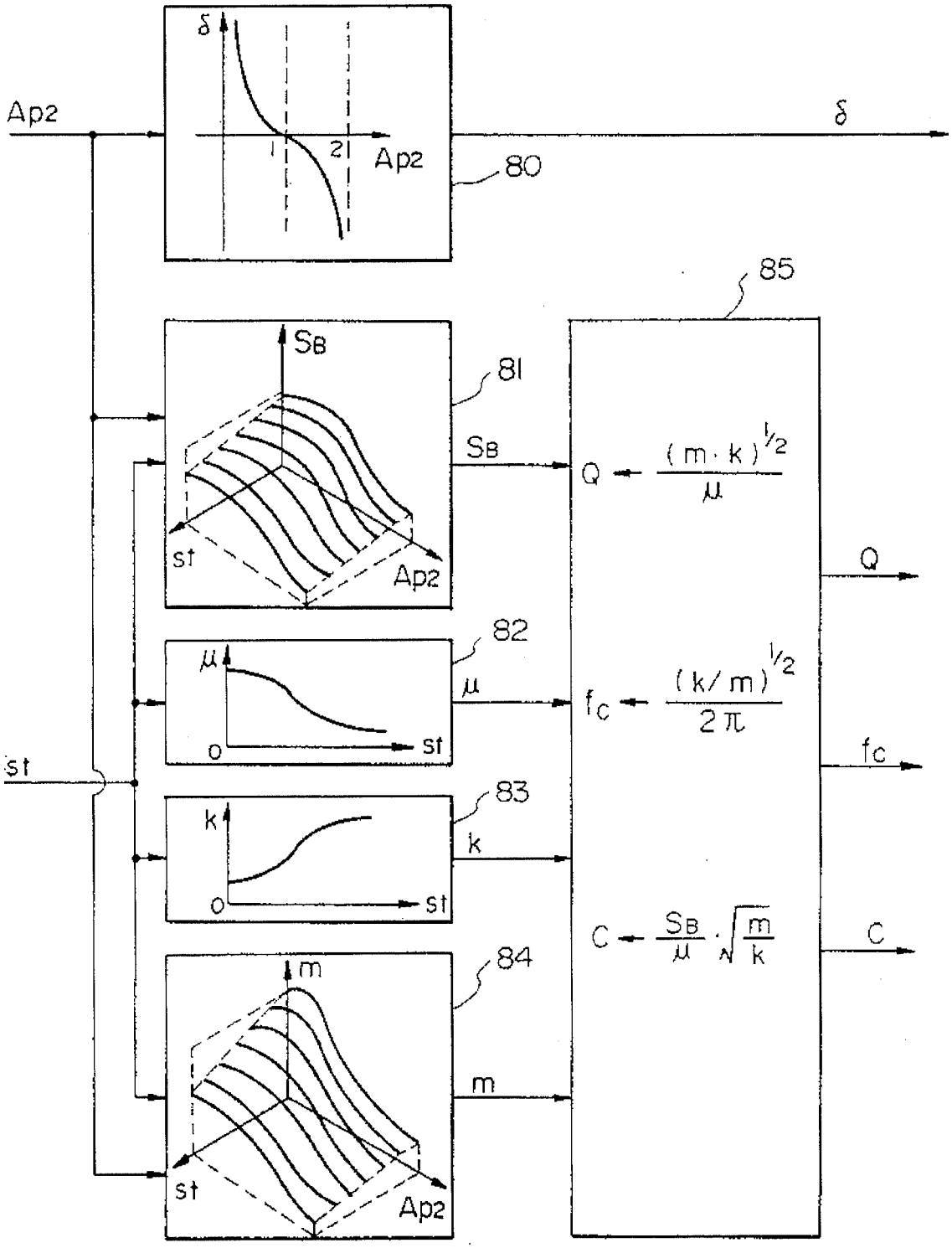
FIG. 18 is a block diagram of parameter variation circuit 17.

The structure of parameter variation circuit 14 in FIG. 1 will be explained hereafter. Parameter variation circuit 18 is set up by calculating circuits 80 to 85, as shown in FIG. 18.

When calculation circuit 80 receives signal $A_{P2}$, which indicates the aperture, it is transformed into parameter δ, on the basis of equation (A3), (or equation (A5) or (A6)).

When calculation circuit 81 (or table) receives signal st indicating strength, and signal $A_{P2}$ indicating the aperture, it outputs parameter $S_B$ indicating the effective oscillating area of the lips, which is derived from a function of two variables (or table). Provided that the lips touch a mouthpiece of a real brass instrument and play while aperture $A_{P2}$ is fixed, in the case of relaxing the lips, they get thick and round, and the more strain is put on the lips, the thinner and flatter they become, and it is obvious that the surface area $S_R$ of the lips oscillating in the mouthpiece becomes smaller. When aperture $A_{P2}$ is kept constant, parameter $S_B$ becomes a monotonic decreasing function against signal st.

When strain st is kept constant, while the aperture is made smaller, the surface area $S_R$ of the lips oscillating in inner part of the mouthpiece increases. Therefore, parameter $S_R$ is a monotonic decreasing function of aperture $A_{P2}$ when strain st is a constant.

Operation circuit 82 (or table) transforms signal st into parameter μ indicating a constant damping of the lips. When it is assumed that there is an oscillation in the lips of the real player, the more the lips are strained, the harder they get, and since it becomes difficult to dampen the oscillation of the lips, the damping constant becomes small. Accordingly, parameter μ becomes a monotonic decreasing function against signal st.

Processing circuit 83 (or table) transforms signal st to parameter k, indicating the elastic constant of the lips. The lips of the real player get harder with the strain, and since the elastic constant increases, parameter k becomes a monotonic decreasing function against signal st. Processing circuit 84 (or table), when receiving signal st and signal $A_{P2}$, outputs parameter m indicating the effective oscillating mass of the lips, which was determined by means of a function with two variables (or table). As mentioned above, for the case when aperture $A_{P2}$ is constant, the lips of the real player, when strained, become thin and flat, and obtained mass m of the lips oscillating inside the mouthpiece, becomes small. Accordingly, parameter m becomes a monotonic decreasing function against signal st. On the other hand, when strain st is kept constant, obtained mass m of the lips oscillating inside the mouthpiece becomes big when the aperture is made small. Parameter m is a monotonic decreasing function of aperture $A_{P2}$ when strain st is constant.

All the parameters $S_B$, μ, k and δ, which were obtained by processing circuits 81 to 84, are transferred to processing circuit 85. Processing circuit 85 calculates by means of equations (A16) to (A18), amplitude gain ratio of each tone, cut off frequencies, parameters Q, fc and C, indicating peak gains, and puts those values out.

E. STRUCTURE OF EXCITATION CIRCUIT 15

(1) General structure of excitation circuit 15

Figure 19:
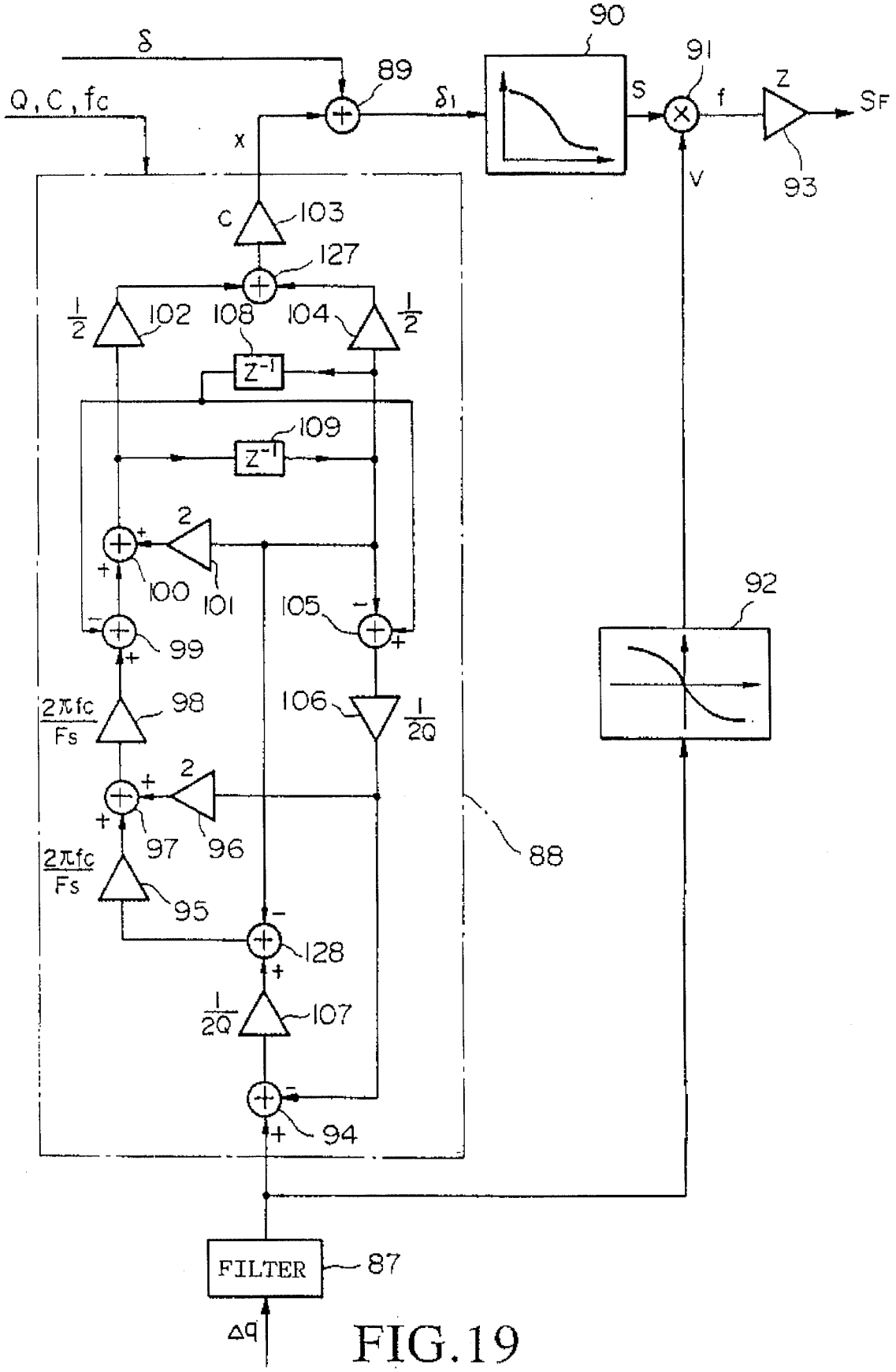
FIG. 19 is a block diagram of excitation circuit 15.

The structure of excitation circuit 15 is explained by referring to FIG. 19.

Pressure difference signal Δq output from subtracter 16 (referring to FIG. 1) is transferred via filter 87 to dynamics filter 88 and Graham function table 92. Filter 87 prevents parasitic oscillations by removing higher harmonic components coming from pressure difference signal Δq. Graham function table 92 which, when supplied with pressure difference signal Δq, via filter 87, carries out operation (Graham function) of equation (A1) and passes this result as speed signal v to multiplier 91.

Dynamic filter 88 outputs displacement signal x describing the displacement of lips 3, obtained by means of pressure difference signal Δq parameter Q, $f_c$, and C. Details of dynamics filter 88 follow hereafter.

Displacement signal x is added to parameter δ in adder 89, and forwarded as parameter $\delta_1$, to slit function table 90. Slit function table 90 carries out the transformation of parameter $\delta_1$ $$S = 1 - \frac{\delta_1}{(\delta_1^2 + 1)^{1/2}} \tag{E1}$$

and forwards parameter S as the transmission result to multiplier 91. Since equation (E1) has the same structure as equation (A2), it is the reciprocal value of equation (A3). Therefore, when $\delta=\delta_1$, in other words, when x=0, parameter S becomes equal to parameter $A_{P2}$ describing the aperture. Since parameter $\delta_1$ is the sum of displacement signal x and parameter S, it rises and falls according to the rise and fall of displacement signal x. By this, it becomes obvious that parameter S simulates opening area S of the lips, while performing on a real brass instrument as shown in FIG. 2(B).

Multiplier 91 multiplies speed signal v with parameter S and outputs the multiplication result as flux signal f. In multiplier 93, flux signal f is multiplied with a constant z. Constant z is the resistance against the air flux of mouthpiece 21 and resonance tube 20 of the physical model of FIG. 2(A); in other words, the proportional constant of air flux and air pressure. Accordingly, signal $S_F$ indicating air pressure change, is output from multiplier 3. Then, signal $S_F$ is added to reverse wave R at junction 17, and transmitted via tubus realization circuit 18, as progressive wave signal F.

(2) Construction of dynamics filter 88

Figure 20:
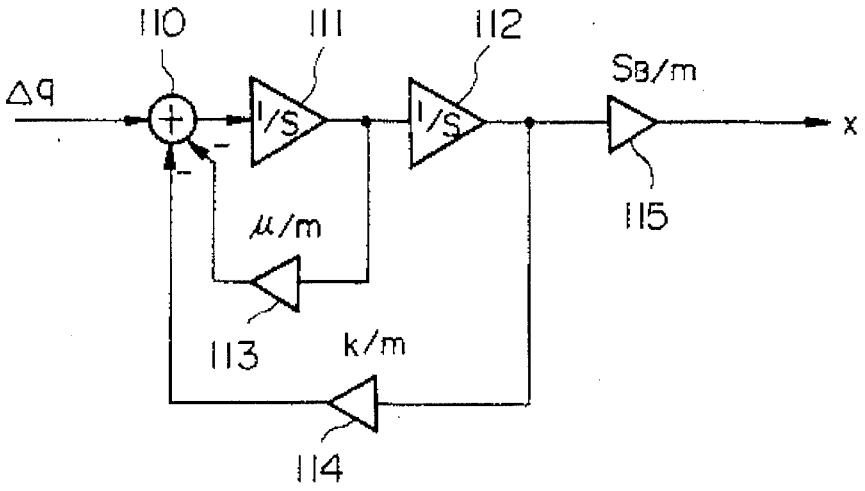
FIGS. 20 and 21 are block diagrams of a variation example of excitation circuit 22.

More details concerning the structure of dynamics filter 88 are explained, and in convenience of the explanation, the structure of the analog filter which serves as a reference, is explained by referring to FIG. 20.

(i) Structure of the analog filter for reference use

The analog filter shown in FIG. 20 (dynamics filter) which represents equation (A11) by an analog circuit, comprises a subtracter 110, integrators 111 and 112, and multipliers 113 to 115 for multiplying parameters μ/m, k/m and $S_B$/m, each input by signals, and forwarding the output.

(ii) Theoretical background .of dynamics filter 88

The dynamics filter of FIG. 20 is a construction which outputs displacement signal x, indicating displacement of the lips, by directly inputting parameters $S_B$, k and m. When the dynamics filter is constructed in such a way that it outputs displacement signal x based on parameters Q, $f_c$ and C, which are the characteristics of this tone, the tone can be controlled much more easily. Therefore, the transfer function based on parameters Q, fc and C is needed. The transfer function H(s) of the dynamics filter is indicated in FIG. 20 and reads $$\begin{aligned} H(s) &= \frac{a^2 b}{s^2 + abs + a^2} \\ &= \frac{a^2 b}{(s + ab/2 - j\sqrt{a^2 - a^2 b^2/4})(s + ab/2 + j\sqrt{a^2 - a^2 b^2/4})} \end{aligned} \tag{E3}$$

Figure 22:
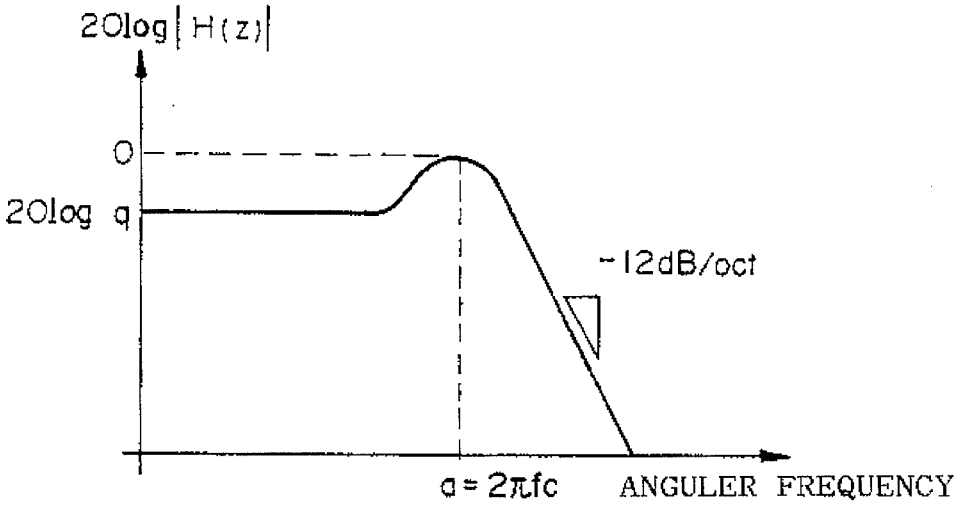
FIG. 22 shows the frequency characteristics of them.

In equation (E3) b=1/Q, and $a=2\pi f_c$. When the amplitude characteristic |H(s)| of equation (E3) is plotted, it has the form as shown in FIG. 22, and it becomes obvious that the characteristic of this dynamics filter show those of a low-pass filter of the second order.

A transformation method for approximating the transfer function of an analog filter with a digital filter is known as conform z transformation. In general, when the transfer function $$H(s)=\frac{A\cdot\prod_{m=1}^{M}(s-s_m)}{\prod_{k=1}^{N}(s-s_k)} \tag{E4}$$

undergoes conform z transformation, it becomes $$H(z)=\frac{A\cdot\prod_{m=1}^{M}T^{-1}(1-\exp(s_m\cdot T)z^{-1})\,(1+z^{-1})^L}{2^L\prod_{k=1}^{N}T^{-1}(1-\exp(s_k\cdot T)z^{-1})} \tag{E5}$$

Accordingly, when (E3) undergoes conform z transformation for L=1 in equation (E5)

$$H(z)=\frac{ba^2T^2(1+z^{-1})/2}{1-2\exp(-aTb/2)\cdot\cos(aT\sqrt{1-b^2/4})\cdot z^{-1}+\exp(-aTb)\cdot z^{-2}} \tag{E6}$$

is obtained.

Moreover, when in equation (E6), $$\exp(x)=1+x \tag{E7}$$

$$\cos(y)=1-\frac{y^2}{2}$$

are approximated, the denominator of equation (E6) is obtained as shown hereafter.

$$Den.=1-2(1-aTb/2)(1-a^2T^2(1-b^2/4)/2)z^{-1}+(1-aTb/2)^2$$

$$Den.=1-2(1-aTb/2+a^2T^2(1-b^2/4)/2+a^3T^3b(1-b^2/4)/4)z^{-1}+(-aTb+a^2T^2b^2/4)z^{<2} \tag{E8}$$

If all the "aT" are disregarded from third order onwards, as aT<<1, the denominator becomes $$Den.=1-2z^{-1}+(aTb+a^2T^2(1-b^2/4))z^{-1}+z^{-2}++(-aTb+a^2T^2b^2/4)z^{-2}\{ \tag{E9}$$

and therefore, transfer function H(z) is approximated as shown hereafter.

$$H(z)=\frac{qa^2T^2(1+z^{-1})/2}{1-2z^{-1}+(aTb+a^2T^2(1-b^2/4))z^{-1}+z^{-2}+(-aTb+a^2T^2b^2/4)z^{-2}} \tag{E10}$$

Dynamics filter 88 in FIG. 19 is constructed on the basis of equation (E10).

Multipliers 95 and 98 in this figure multiply each of the passing signals with $2\pi f_c/F_s$ (provided that $F_s$ is the sampling frequency) and put them out. Multipliers 101, 102, 104, 106 and 107 multiply passing signals with "2", "1/2", "1/2", 1/2Q and 1/2Q and put them out. There are subtracters 94, 99, 105 and 128, adders 97, 100 and 120, and delay circuits 108 and 109, having a delay time identical to the one of the sampling cycle. Within the dynamics filter 88, the part reaching adder 127, coming from subtracter 94, is the part corresponding to equation (E10) (in equations (E3)–(E10), the peak gain is normalized). The after signal of adder 127 is transferred to multiplier 103, multiplied with peak gain C and output as displacement signal x.

(3) Variation example

Above said excitation circuit 15 can, for example, be varied as shown below.

(i) variation example 1

Figure 21:
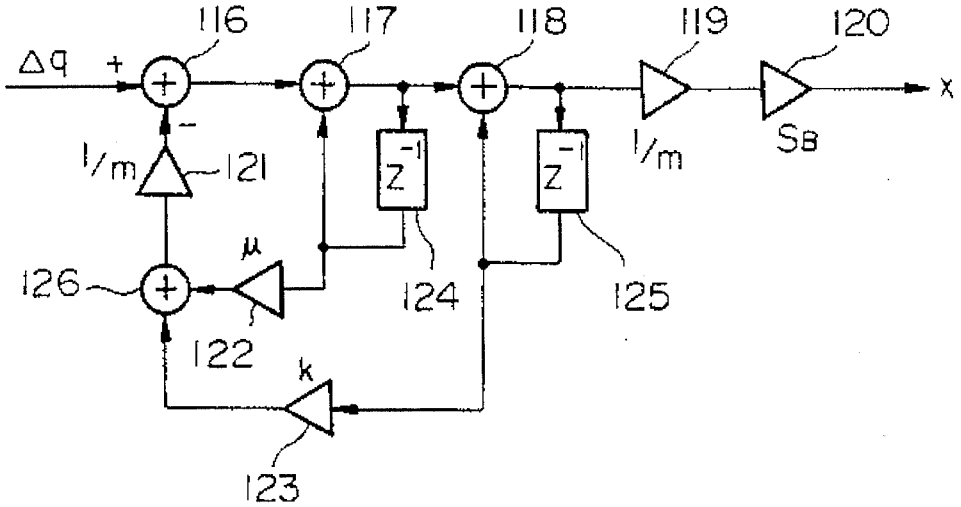

Dynamics filter 88 can also be replaced by the digital filter shown in FIG. 20 acting like the explained dynamics filter. In case of using this variation example, of course operation circuit 85 in FIG. 18 can be omitted. For explaining the details of this digital filter, FIG. 21 is referred to hereafter.

In this figure, subtracter 116 subtracts the output signal of multiplier 121 from signal Δq, and puts it out.

Furthermore, there is an adder 117 and a delay circuit 124 having a delay time equal to the cycle time in which the digital signal is supplied. The signal output by adder 117 is input into delay circuit 124, delayed for one cycle period, and forwarded to adder 117. Then, the output signal from subtracter 116 and the output signal from delay circuit 124 are added in adder 117, and the result of this addition again is forwarded to delay circuit 124. In other words, adder 117 and delay adder 124 form an integrating circuit, and the integration value of the output of adder 116 is output.

Similar to this, the integrating circuit is formed by adder 118, and delay circuit 125, and the integration value of the output of adder 117 is output. The output signal of adder 118 is calculated per meter via calculator 119, multiplied by $S_b$ via multiplier 120 and output as signal x.

The output signal of adder 117 is forwarded to multiplier 122 via delay circuit 124, and after having been multiplied there by μ, is forwarded to adder 126. In the same way, the output signal of adder 118 is forwarded to multiplier 123 via delay circuit 125, and after being multiplied there by k, forwarded to adder 126. The output signals of multiplier 122 and 123 are added at adder 126, the result of this addition is multiplied by 1/m via multiplier 121 and forwarded to subtracter 116.

At subtracter 116, the output signal of multiplier 121 is subtracted from pressure difference signal Δq, and the subtraction result is forwarded to adder 117. In other words, the feedback operation is performed in subtracter 116, and the transfer function H(z)=X(z)/ΔQ(z) is regarded equal to the approximately digitalized substitution of the analog transfer function shown in equation (A11).

F. OPERATION OF THE PREFERRED EMBODIMENT

The operation of the preferred embodiment is explained hereafter by referring to FIG. 1.

When lips 3 of the player are pressed against contact area sensor 4, a signal corresponding to the contact area of lips 3 is output from contact area sensor 4. This signal is transformed to a digital signal $S_L'$ by A/D converter 8 and forwarded to operation circuit 22. This operation circuit 22, a circuit which considers that the output level of A/D converter 8 does not provide the precise ratio of the contact area, calculates signal $S_L$ on the basis of formula $$S_L=\frac{\alpha}{S_L} \tag{F1}$$

(provided that α is a constant ratio) and forwards it to operation circuit 12. Simultaneously, the signal showing the push pressure at the time when lips 3 are pressed against contact area sensor 4 is output by pressure sensor 5. This signal is transformed into digital signal $P_L$ by A/D converter 9 and forwarded to operation circuit 12. The signal indicating the opening area (aperture) of lips 3 is output by aperture sensor 6, converted into digital signal $A_{P1}$ by A/D converter 10, and forwarded to operation circuit 13. The signal indicating the blow pressure generated by the breath of the player is output via air pressure sensor 7 and converted into digital signal $P_B$ by A/D converter 11.

Signal st indicating the tonus of the lips based on above mentioned signals $S_L$ and $P_L$ as well as on equation (A21), is output in operation circuit 12. In operation circuit 13, above said signal $A_{P1}$ is corrected by proportioning accurately the .opening area of lips 3 and putting it out as signal $A_{P2}$.

When above said signal st and $A_{P2}$ are forwarded to the parameter converting circuit, there, all the parameters δ, C, $f_c$ and Q are calculated and forwarded to excitation circuit 15. Blow pressure signal $P_B$ is forwarded to subtracter 16. In subtracter 16, blow pressure signal $P_B$ is subtracted from reflected wave signal $S_R$ and the subtraction result is forwarded to excitation circuit 15 as pressure difference signal $\Delta q$. Since in the initial state the level of the reflected wave signal $S_r$ is 0, the sign inverted blow pressure signal $P_B$ is forwarded to excitation circuit 15 as pressure difference signal $\Delta q$.

In excitation circuit 15 pressure difference signal $\Delta q$ is forwarded via filter 87 (see FIG. 19) to dynamics filter 88 and Graham function table 92. In dynamics filter 88, displacement signal x simulating the displacement of lips 3 derived from above said parameters $\delta$, C, $f_c$ and Q as well as pressure difference signal $\Delta q$, is output, and added to parameter $\delta$ via adder 89. This addition result is forwarded to slit function table 90 as parameter $\delta_1$ and signal S indicating the opening area of lips 3 is output.

In Graham function table 92, speed signal v is calculated on the basis of pressure difference signal $\Delta q$, and this speed signal v is forwarded to multiplier 91. In multiplier 91, speed signal v and parameter S are multiplied and the multiplication result is output as flux signal f. This flux signal f is multiplied with constant z in multiplier 93 and output via junction 17 as progressive wave signal $S_F$ to tubus realization circuit 18.

In tubus realization circuit 18, the progressive wave signal $S_F$ is transferred by the delay circuit, the low pass filter and other parts provided therein, (see figure) and in reflection circuit (see figure) reflected wave signal $S_R$ is generated. Then, reflected wave signal $S_R$ is transmitted into the opposite direction by above said delay circuit, low pass filter and other components, and forwarded to subtracter 16 via junction 17.

In subtracter 16, blow pressure signal $P_B$ is subtracted from reflected wave signal $S_R$ and the subtraction result is forwarded to simulation circuit 15 as pressure difference signal $\Delta q$. Then, this new progressive wave signal $S_F$, which is based on this pressure difference signal $\Delta q$ is output a similar procedure to the one described is being repeated.

Then, progressive wave signal $S_F$ is output via sound system 19 and the tone of the brass instrument is simulated.

[Result of invention]

Since according to the above given explanation of a tone synthesizing device of the present invention, the pitch of the tone signal is decided by means of the tonus of the lips; thus a possibility for faithfully simulating the tone of a brass instrument is given.

What is claimed is:

1. A performance information input device for an electronic musical instrument comprising:

a mouthpiece for being in contact with a player's lips;

a contact area sensor provided as part of said mouthpiece so as to come into contact with said lips, said contact area sensor detecting an amount of area of said contact area sensor contacted by said lips; and a pressure sensor provided as part of said mouthpiece for detecting an amount of push pressure exerted by said lips on said contact area sensor.

2. A performance information input device according to claim 1 wherein said mouthpiece is designed so as to be blown into by the player's lips.

3. A performance information input device as claimed in claim 1 wherein said pressure sensor is different from said contact area sensor and said electronic musical instrument generates a musical tone signal based on said detected amount of contact area and said detected amount of push pressure.

4. A performance information input device according to claim 1, wherein said mouthpiece is a funnel-shaped device formed of insulating material, and said contact area sensor is provided with a concentric through hole and provided within said mouthpiece.

5. A performance information input device according to claim 1, wherein said contact area sensor includes two spaced conductive plates.

6. A performance information input device for an electronic musical instrument comprising:

a mouthpiece for being in contact with a player's lips; and an aperture sensor provided as part of said mouthpiece for detecting an area of an aperture formed by said lips, said aperture sensor comprising:

light emitting means for projecting light onto said lips; and light receiving means for receiving light reflected off of said lips.

7. A performance information input device according to claim 6 wherein said mouthpiece is designed so as to be blown into by the player's lips.

8. A performance information input device according to claim 6, wherein said mouthpiece has a body having an annular cross-section, and said aperture sensor is formed into a circular disk-shaped device placed within said body.

9. A performance information input device for an electronic musical instrument according to claim 6 wherein said electronic musical instrument comprises means for generating an excitation signal based on an area detected by said aperture sensor.

10. A performance information input device for an electronic musical instrument comprising:

a mouthpiece provided to come into contact with a player's lips;

a contact area sensor, provided as part of said mouthpiece and positioned so as to be pressed by said lips, for detecting an amount of area of said contact area sensor contacted by said lips, said contact area sensor bending when pressed by said lips; and a pressure sensor, adjacent to and stratified with said contact area sensor, for detecting an amount of push pressure on said contact area between said lips and said mouthpiece by bending along with said bending of said contact area sensor.

11. A performance information input device according to claim 10 wherein said mouthpiece is designed so as to be blown into by the player's lips.

12. A performance information input device according to claim 10, wherein said mouthpiece has a body having an annular cross-section part in which said lips are in contact with, and said contact area sensor and said pressure sensor are placed within said body.

13. A tone synthesizer device comprising a contact area sensor installed so as to come in contact with player's lips and detecting an amount of a contact area of said lips, a pressure sensor for detecting the push pressure of said lips on said contact area sensor, tonus signal generating means to which said contact area and said push pressure is inputted, for outputting a tonus signal which indicates strain of said lips based on a predetermined function which becomes smaller as said contact area gets bigger and becomes bigger as said push pressure gets bigger, tone signal generating means for generating a tone signal whose pitch becomes higher as said tonus signal gets higher.

14. A tone synthesizing device comprising:

blow pressure detection means for detecting the amount of a blow pressure of a player;

operation means for operating on a blow pressure signal corresponding to said blow pressure and a returning signal, and for outputting the operation result as a pressure signal;

excitation means which input said pressure signal and which output an excitation signal;

signal transmission means receiving said excitation signal as an input for delaying the input by a predetermined time and for giving said returning signal to said operation means;

a mouthpiece for being in contact with a player's lips; and a contact area sensor for detecting the amount of a contact area between the player's lips and the mouthpiece; and wherein said excitation means controls said excitation signal in accordance with the detected contact area amount.

15. A tone synthesizing device comprising:

blow pressure detection means for detecting the amount of a blow pressure of a player;

operation means for operating on a blow pressure signal corresponding to said blow pressure and a returning signal and for outputting the operation result as pressure signal;

excitation means which receives said pressure signal and which outputs an excitation signal;

signal transmission means receiving said excitation signal as an input for delaying the input by a predetermined time and for giving said returning signal to said operation means;

a mouthpiece for being in contact with the player's lips;

detection means for detecting each of at least two independent conditions of said lips against said mouthpiece; and excitation characteristic control means for inputting the detection result of said detection means, and for outputting a signal controlling excitation characteristics of said excitation means, wherein said excitation means control said excitation signal in accordance to said detected conditions.

16. A performance information input device as claimed in claim 15 wherein the detection means detects at least two of lip pressure amount, lip contact area amount and lip opening area amount.

17. A performance information input device for an electronic musical instrument comprising:

a mouthpiece for being in contact with a player's lips; and a contact area sensor provided as a part of the mouthpiece, so as to come into contact with said lips, said contact area sensor detecting the amount of a contact area between said lips and the mouthpiece, wherein said contact area sensor includes:

a first sensor member;

a second sensor member, including a second sensor surface; and a resistor between the first and second sensor members;

wherein, when lips contact the first sensor member, the first sensor member contacts the resistor and a portion of the resistor contacts the second sensor surface wherein the size of the contact area of the second sensor surface with the resistor is proportional to the size of the contact area of the lips with the first surface.

18. A performance information input device according to claim 17 wherein the contact area sensor further comprises:

a spacer element between the resistor and the second sensor surface.

19. A performance information input device for an electronic musical instrument comprising:

a mouthpiece for being in contact with a player's lips;

a contact area sensor provided as part of said mouthpiece so as to come into contact with said lips, said contact area sensor detecting an amount of a contact area between said lips and said mouthpiece; and an aperture sensor provided as part of said mouthpiece for detecting an aperture area of said lips, said aperture sensor comprising:

light emitting means for projecting light to said lips; and light receiving means for receiving light reflected by said lips.

* * * * *